US007285708B1

(12) United States Patent
Beckmeier

(10) Patent No.: US 7,285,708 B1
(45) Date of Patent: Oct. 23, 2007

(54) SYSTEM OF STRINGED MUSICAL INSTRUMENTS WITH SUBSTITUTABLE FINGERBOARDS

(76) Inventor: Fred Beckmeier, 1183 Aztec, Topanga, CA (US) 90290

( * ) Notice: Subject to any disclaimer, the term of this patent is extended or adjusted under 35 U.S.C. 154(b) by 0 days.

(21) Appl. No.: 09/531,719

(22) Filed: Mar. 21, 2000

Related U.S. Application Data

(63) Continuation of application No. 09/273,179, filed on Mar. 19, 1999, which is a continuation-in-part of application No. 09/161,246, filed on Sep. 25, 1998, now Pat. No. 6,037,532.

(60) Provisional application No. 60/089,776, filed on Jun. 18, 1998.

(51) Int. Cl.
*G10D 3/06* (2006.01)

(52) U.S. Cl. ..... 84/314 R; 84/315

(58) Field of Classification Search ..... 84/314 R, 84/315, 293, 291, 312 R
See application file for complete search history.

(56) References Cited

U.S. PATENT DOCUMENTS 4,137,813 A * 2/1979 Stone et al. ..... 84/314
5,398,581 A * 3/1995 Castillo ..... 84/291
6,037,532 A * 3/2000 Beckmeier ..... 84/293

* cited by examiner

*Primary Examiner*—Robert E. Nappi
*Assistant Examiner*—Kim Lockett
(74) *Attorney, Agent, or Firm*—Robert J. Sharpe

(57) ABSTRACT

A stringed musical instrument having an elongate neck and a body which may have a resonant cavity at one end and a head at the other end thereof. Strings extend across the neck and, when vibrated, generate musical sounds. The invention relies upon fingerboards which are removable so that one type of fingerboard may be substitutable for another type of fingerboard in order to generate sounds of different timber or of different qualities. Thus, fretted fingerboards are substitutable for non-fretted fingerboards. Moreover, and in a preferred embodiment, the fingerboards are inserted onto the neck of the instrument and can be slid into and out of interlocking elements from one longitudinal side of the neck of the instrument. In one embodiment of the invention, dovetail projections are formed on the neck of the musical instrument and corresponding notches or grooves are formed on the underside of the fingerboard to permit an interlocking arrangement of the fingerboard on the neck of the musical instrument. Compensation in the thickness of fretted and non-fretted fingerboards is also provided to insure that the string of the instrument is only moved the same distance with either fingerboard.

35 Claims, 12 Drawing Sheets

SYSTEM OF STRINGED MUSICAL INSTRUMENTS WITH SUBSTITUTABLE FINGERBOARDS

RELATED APPLICATION

This application is a continuation of my U.S. patent application Ser. No. 09/273.179, filed Mar. 19, 1999, and which is, in turn a continuation-in-part of my U.S. utility patent application Ser. No. 09/161,246, now U.S. Pat. No. 6,037,532 filed Sep. 25, 1998, and entitled "STRINGED MUSICAL INSTRUMENT WITH REMOVABLE FINGERBOARD", and which is, in turn, a continuation-in-part in of and based on my U.S. provisional patent application Ser. No. 60/089,776, filed Jun. 18, 1998, and entitled "STRINGED MUSICAL INSTRUMENT NECK WITH CHANGEABLE FINGERBOARD AND "T" SHAPED TRUSS".

BACKGROUND OF THE INVENTION

1. Field of the Invention

This invention relates in general to certain new and useful improvements in stringed musical instruments and, more particularly, to stringed musical instruments of the type having an elongate neck and a body and which are capable of generating sounds in response to vibration of strings extending across that body and with fingerboards substitutable for one another on the neck of that instrument.

2. Brief Description of the Related Art

In stringed musical instruments the useful or active length of the string is adjusted by pressing the string against a fingerboard on the upper surface of the neck. In generally all cases, the fingerboard is an integral part of the neck of the musical instrument, or otherwise it is permanently affixed to the neck. However, some musical instruments are provided with frets on the fingerboard and are typically referred to as "fretted" musical instruments which allows the user to engage the string of the instrument against a fret so that a useful length is achieved equal to the distance between the fret and the bridge. This will create a note of precisely defined timber and also of metallic character. Other instruments without frets are often referred to as "fretless" instruments and the useful length of the string is determined by the distance between the point at which the player keeps the string pressed against the fingerboard and the bridge. In absence of the fret, there is a lack of metallic quality to the sound and the sound also has a softer character.

It is, however, important in connection with any stringed musical instrument to insure that the distance between the string in its normal unactuated condition and the upper surface of the fingerboard is precisely controlled and remains the same. Otherwise, if this distance should effectively change, even by a small amount, the musical quality of the instrument is altered and frequently to the detriment of the generated sounds. Moreover, it is critical in connection with any stringed musical instrument to insure that the fingerboard is tightly mounted onto the neck of the musical instrument. Otherwise, vibrations between the fingerboard and the neck of the instrument would be generated and this, again, results in a deficit of the musical quality.

It may be appreciated that for certain musical pieces, fretted instruments are desired and for other musical pieces, fretless instruments are desired. However, since there is no convenient means for altering an instrument with frets, or without frets, the average musician must constantly carry at least two such instruments, one containing frets and one without frets. In particular, for the bass guitar and the slide or so-called "bottle neck" six-string guitar, each player almost inevitably carries at least two musical instruments for this purpose. However, this limits the player in attaining the desired musical flexibility while retaining the feel and capabilities of a preferred instrument.

There have been at least two proposals to provide a stringed musical instrument with interchangeable fingerboards. One such proposed arrangement is set forth in U.S. Pat. No. 4,137,813, dated Feb. 6, 1979, to Stone, et al. In this patent, Stone, et al proposed interchangeable fingerboards having differed fret arrangements, but never suggested the concept of substituting a fretted board for a non-fretted board. Stone, et al did suggest the mounting of a fingerboard to a musical instrument in a detachable fashion, but pointed out the critical problem of potential vibration which can result between the neck of the instrument and the fingerboard. The Stone, et al '813 patent, however, proposed groove arrangements in both the underside of the fingerboard and the upper surface of the instrument neck.

In U.S. Pat. No. 4,132,143, dated Jan. 2, 1979, to Stone, the patentee employs a plurality of very closely spaced apart grooves on the underside of the fingerboard and projections on the upper surface of the neck. These grooves and projections are longitudinally spaced apart from one another by very short distances and, hence, a large number of such grooves and projections are employed. Although Stone may potentially eliminate the problems of vibration, this arrangement also creates a rigidity and does not allow the fingerboard to conform to the arc of the neck accounting for the normal flexing of the neck and makes insertion of the fingerboard virtually impossible. Consequently, the arrangements in the Stone, et al '813 and in the Stone '113 patent have not been effectively commercially utilized.

U.S. Pat. No. 4,352,450, to Novack, also discloses different fret arrangements for use on musical instruments. However, the fingerboards containing these different fret patterns are not removably mounted on the neck of the musical instrument, as such.

There have been several attempts in the prior art to provide stringed musical instruments in which frets can be used or withdrawn. In U.S. Pat. No. 4,267,936 to Mouton, there is provided a stringed musical instrument having retractable frets. In this case, an electric base guitar is provided with retractable frets, such that in one position, the frets are flush with the surface of the fingerboard and, in another position, the frets are raised above the surface of the fingerboard. The neck of the instrument has an inclined slope on one side causing wedge shaped feet on the frets to ride on this inclined slope for raising and lowering the frets.

There is a also a proposed stringed musical instrument having retractable frets described in U.S. Pat. No. 4,772,260 to Pigozzi. In this case, a guitar has a fingerboard in which the frets are slidably disposed within the neck holding the fingerboard. A rather complex mechanism, including cams, springs and a rotatable shaft, are provided for raising and lowering the frets. While this type of instrument may be attractive in theory, as a matter of practicality, the mechanism used is quite complex and significantly adds to the overall height, and certainly to the cost of the musical instrument.

In each of the aforesaid prior art systems for providing frets and effectively removing frets, they would be inherently slow and cumbersome. Consequently, these systems are not effective for the average musician who desires to quickly change from a fretted instrument to a fretless instrument. As a result, systems of the types proposed in these patents have not been effectively used.

There has clearly been a need for a single musical instrument which can be properly tuned and adapted to the particular use of a certain musician. Clearly, the complex and unworkable proposals advanced in Pigozzi patent and in the aforesaid patent to Mouton have not been effective and not usable in terms of converting a single musical instrument from a fretted instrument to a non-fretted instrument. Moreover, and although the aforesaid Stone patents suggested the changing of fingerboards, Stone never suggested the alteration of the same musical instrument from a non-fretted to a fretted instrument. In addition, the interlocking arrangement of the fingerboard to the neck of the musical instrument was literally unusable in actual operation due to the complexity and difficulty of changing one fingerboard for another. Thus, this need has existed and still remains.

OBJECTS OF THE INVENTION

It is, therefore, one of the primary objects of the present invention to provide a stringed musical instrument of the type having an elongate neck with fretted fingerboards and non-fretted fingerboards being easily and readily substitutable for one another on the neck of the musical instrument.

It is another object of the present invention to provide a stringed musical instrument of the type stated in which the overall thicknesses of the substitutable fingerboards are adjusted so that the distance between the playing surface of the fingerboard and the strings of the instrument effectively remain the same.

It is a further object of the present invention to provide a stringed musical instrument of the type stated in which a fretted fingerboard can be rapidly removed from the neck of a musical instrument and a non-fretted fingerboard inserted back onto the neck of the musical instrument by slidably shifting the fingerboards with respect to the neck of the musical instrument.

It is also an object of the present invention to provide a stringed musical instrument of the type stated in which fingerboards can be rapidly replaced for one another and which does not require re-tuning or adjustment of the musical instrument.

It is an additional object of the present invention to provide a stringed musical instrument of the type stated in which the neck of the musical instrument can be reinforced with one or more reinforcing members extending through that neck.

It is still a further object of the present invention to provide a method of converting a stringed musical instrument from a fretted musical instrument to an unfretted musical instrument.

It is yet another object of the present invention to provide a fingerboard retaining blank which can be used for retaining a fingerboard when not secured to the neck of a musical instrument in order to preclude warpage thereof.

With the above and other objects in view, my invention resides in the novel features of form, arrangement and combination of parts and components presently described and pointed out in the claims.

BRIEF SUMMARY OF THE INVENTION

The present invention relates in general to stringed musical instruments of the type which have an elongate neck and a body with a resonant cavity at one end of the neck and a head at the other end of the neck. Strings are stretched across the neck and over the resonant cavity body. Vibration of the strings results in the generation of musical sounds in a sound generating chamber. This holds true for both the non-electric type musical instrument, as well as electrical musical instruments. The latter type of instrument is fitted with transducers to enable the generation of musical sound. In either case, the chamber provides for generating sound from resonance of the strings in a standard manner in stringer musical instruments, or from a transducer is provided in the body of the instrument.

In the illustrated embodiment of the invention, as hereinafter set forth, an electric bass guitar is illustrated. Moreover, this instrument is provided, in normal construction, with four strings. However, any stringed musical instrument, e.g., five sting, six string musical instruments, etc., can also be used in accordance with the present invention. Nevertheless, the substitution of fretted for non-fretted fingerboards and of non-fretted for fretted fingerboards is highly effectively employed in connection with bass guitars.

In all embodiments of the invention, a fingerboard is provided on the neck of the musical instrument. This invention relates in a broad aspect to a means for removing a fingerboard, such as a fretted fingerboard, and substituting on that neck a non-fretted fingerboard and vice versa. Preferably, although not necessarily, the means for removing the fingerboard and repositioning a different fingerboard does not require manually manipulating mechanical fasteners.

It is important in connection with the present invention that the removal of one fingerboard and the remounting of another fingerboard is accomplished very quickly and with a minimal amount of manual manipulation. In this way, a musician can readily change from a fretted musical instrument to a non-fretted musical instrument using essentially the same musical instrument, but with different fingerboards and without need for readjustment of the instrument.

It is also important in connection with the present invention to insure that when the fingerboard is mounted to the neck of the musical instrument, there is no relative vibration existing between the fingerboard and the neck of the instrument. In other words, the fingerboard should not vibrate independently of the neck of the instrument. In addition, it should not bind the neck and otherwise inhibit the neck from its natural bending or bowing function.

In addition to the foregoing, the height of the fingerboard relative to the underside of the strings must be carefully maintained. There is a precise pre-established distance between the strings and the surface which is contacted by the strings during the playing of the musical instrument. In the case of the fingerboard having frets thereon, the strings would be normally depressed for a lesser distance then they would be if a fingerboard having no frets present on the fingerboard was used on the instrument and the strings were pushed into contact with the surface of that fingerboard. In that event, the musical instrument would effectively be out of adjustment when substituting a fretted fingerboard for a non-fretted fingerboard and vice versa.

The present invention literally relies upon a system of individual features which actually cooperate to allow the rapid and efficient interchangeability of a fretted fingerboard for a non-fretted fingerboard and vice versa. Specifically, this system or assembly of unique features comprises a plurality of uniquely designed interlocking elements which removably lock a fingerboard onto the neck of the musical instrument, and the fact that the interlocking elements are designed so that a fingerboard can be slid from one longitudinal side of the neck toward the opposite longitudinal side and physically lock into position when installed on the neck of the musical instrument. This combination of features further includes compensation by differential thickness in the fingerboards so that the non-fretted fingerboard has a thickness equal to the overall thickness of the fretted fingerboard plus the height of the frets above that fingerboard. To further facilitate the efficient and quick removal of one fingerboard and the installation of another, a dual type of locking system is employed in which interlocking elements on the neck of the musical instrument engage corresponding grooves on the underside of the fingerboard and which operates in combination with a differing type of lock mechanism at the opposite ends of the neck. The number of interlocking elements relative to the length of the neck of the fingerboard is also uniquely determined so that the fingerboard will not inhibit the natural flexing of the necks and yet will move precisely with the neck.

The present invention actually provides several embodiments for releasably mounting the fingerboard to the neck of the musical instrument. The more preferred embodiments are those which do not require the need for mechanical fasteners to be manipulated or adjusted. In each of these cases, wedge shaped interlocking elements on the neck of the musical instrument are slid into correspondingly shaped grooves on the underside of the fingerboards. However, other means for securing the fingerboards, such as the use of screws or magnetic coupling, or the like, may be employed.

By employing interlocking elements on the neck of the musical instrument and grooves on the underside of the fingerboards, the fingerboard itself will slide from one longitudinal side of the neck toward the opposite longitudinal side. Where the grooves and the projecting elements are formed with the proper tolerance, the fingerboard will precisely come to rest when the fingerboard is in precise marginal registration with the neck of the musical instrument. In a more preferred embodiment of the invention, interlocking elements using a dovetail construction have been found to be highly effective. Moreover, for a musical instrument neck having a length of about 24 inches to 26 inches, it has been found that the number of interlocking elements should not be less than four and should not exceed seven. In addition, a differing type of end interlocking element in the nature of a ball and detent arrangement is also employed. The ball and detent precisely locks the fingerboard in marginal registration with the edges of the neck and also applies an upwardly biasing force which, in turn; further causes a greater locking force between the fingerboard and the musical instrument.

The present invention actually provides several other means for releasably mounting the fingerboard to the neck of the musical instrument. In one embodiment, the fingerboard is secured to the neck by removable mechanical fasteners, such as screws. In this case, the heads of the screws would be counter-sunk into the fingerboard so that they do not protrude above the surface of the fingerboard. Another embodiment of the invention uses, for example, magnets mounted within the fingerboard and within the upper surface of the neck of the musical instrument. Thus, the fingerboard is magnetically coupled to the neck of the musical instrument.

Due to the fact that the neck of the musical instrument has a reduced cross-sectional thickness as a result of forming a removable fingerboard, it may be desirable to reinforce the neck of the musical instrument to prevent bending moment forces from potentially cracking the neck or breaking the neck, particularly at the region of joinder to the head or the body. For this purpose, a reinforcing truss may be inserted through the neck and the head and body. The reinforcing truss does not necessarily protrude to the full opposite ends of the instrument, although in some cases, the reinforcing truss, which is in the nature of a fairly rigid truss, extends from the outer end of the head to the outer end of the body and through the neck of the instrument. Further, the reinforcing truss may be in the form of an I-beam or a T-beam type structural member.

It is also possible to form the neck of the musical instrument of laminated layers as, for example, layers of plastic and wood so as to provide increased strength. Further, the neck of the musical instrument could also be formed of reinforced plastic composite materials, such as boron with epoxy resins or carbon fibers with epoxy resins, and the like. Reinforcement could also be provided by other forms of reinforced plastics as, for example, other metals and fibers along with thermoplastic or thermosetting resins.

The present invention also provides an embodiment in which a tensioning rod, functioning as a tuning rod, is located in a generally rectangular groove formed in the upper surface of the neck and, particularly, in the upper surface of that portion of the neck having reduced cross-sectional thickness. The tuning rod located in this generally rectangular groove allows for applying tension to the musical instrument after fabrication thereof. In addition, it has been found that one or more reinforcing strips formed of reinforced plastic composite material and located on opposite sides of the tuning rod is also highly effective. Thus, for example, the reinforcing strips could be formed of an epoxy resin, carbon fiber composite material. These strips are preferably located on opposite sides of the tuning rod and extend longitudinally through the neck and into the head and the body.

The present invention further provides a storage blank or retaining board which is provided for retaining one of the fingerboards when not in use on the instrument. This retaining blanks essentially conforms to the neck of the musical instrument with the recess forming the reduced thickness and also includes a corresponding means for mounting the fingerboard. Thus, in the case where beveled opposite edges are formed in the recess and on the fingerboard, such beveled edges would also exist in the retaining member. Again, if magnets are used on the neck of the musical instrument to hold the fingerboard, magnetic means would also be provided with the retaining member.

The present invention thereby fulfills the above and other objects and advantages in the provision of both an improved musical instrument and a method for modifying the musical instrument to provide for removable fingerboards. The improved musical instrument and the method of the invention is further exemplified by the following details description and the accompanying drawings. However, it is to be understood that this following detailed description and the accompanying drawings are set forth only for purposes of illustrating the general principles of the invention. Therefore, this following detailed description and the accompanying drawings are not to be taken in a limiting sense.

BRIEF DESCRIPTION OF THE DRAWINGS

Figure 1:
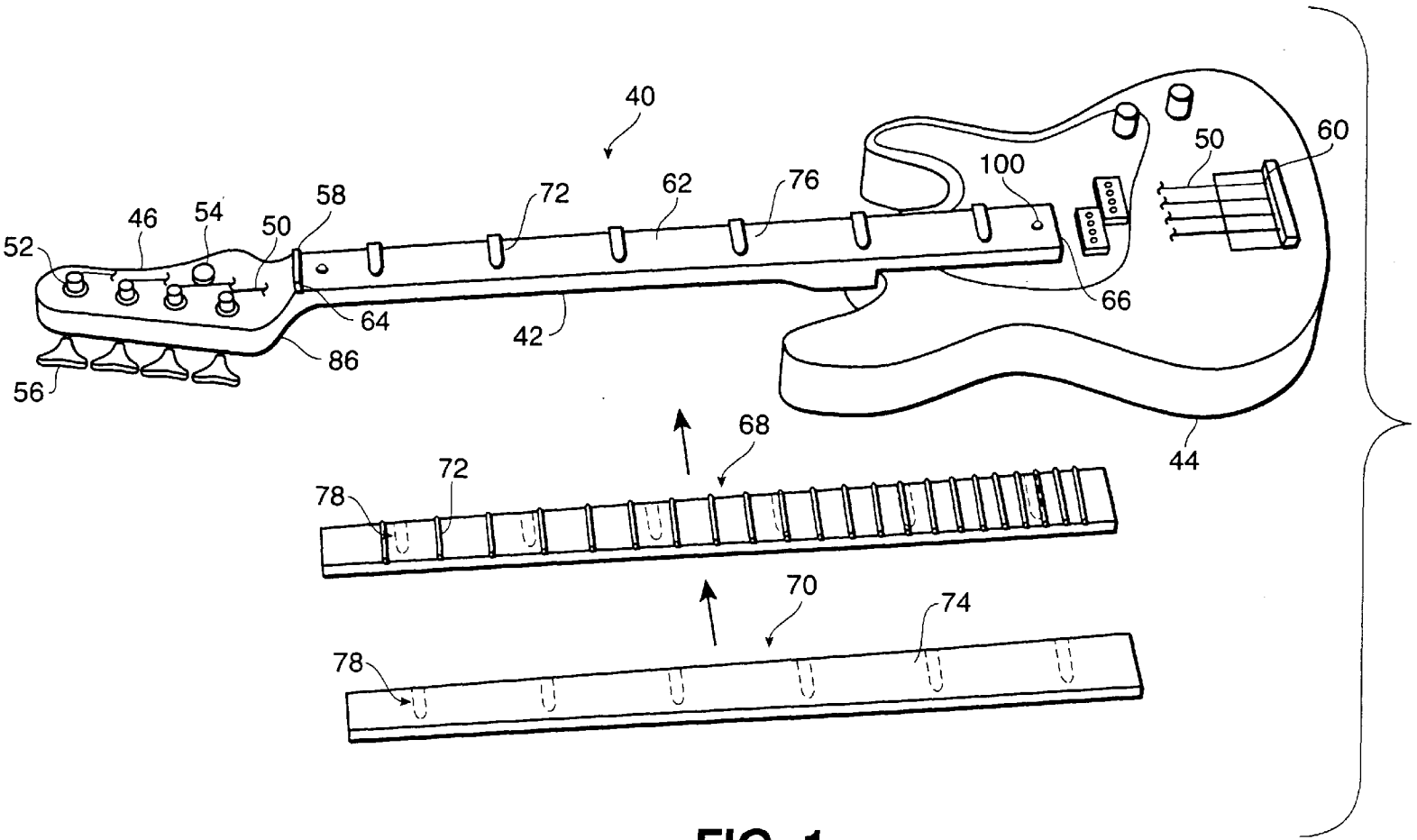
Figure 2:
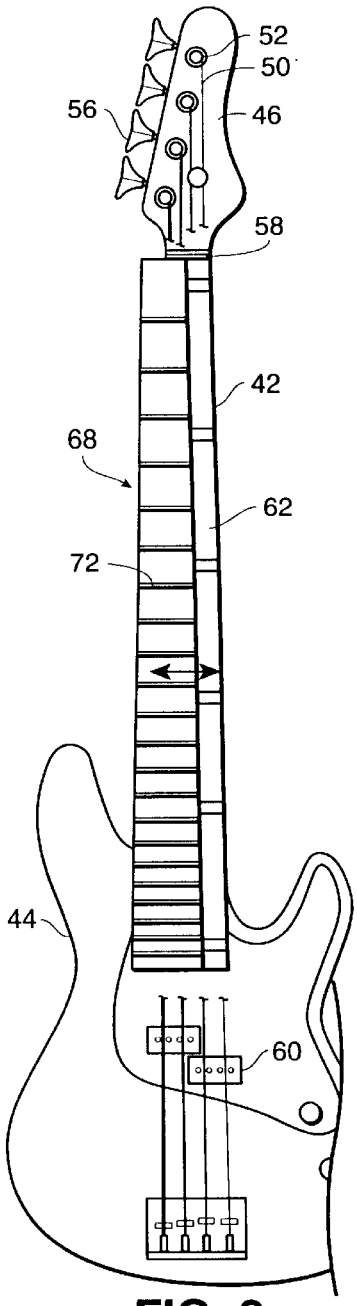
Figure 3:
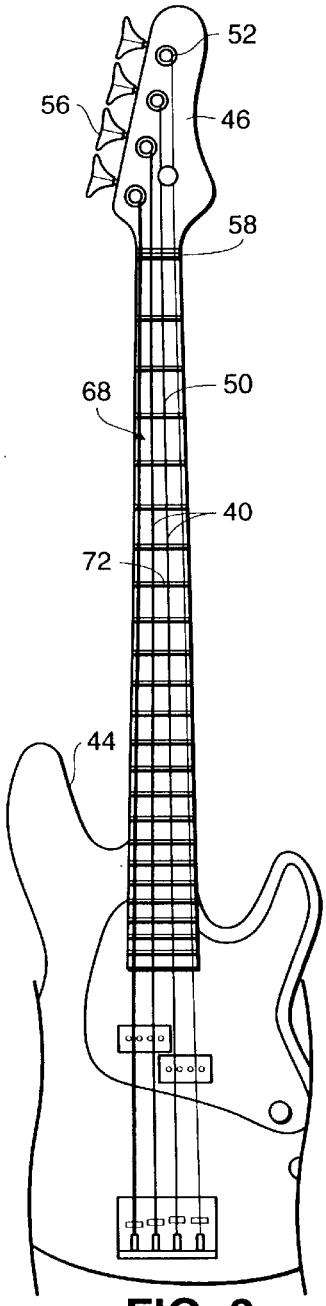
Figure 4:
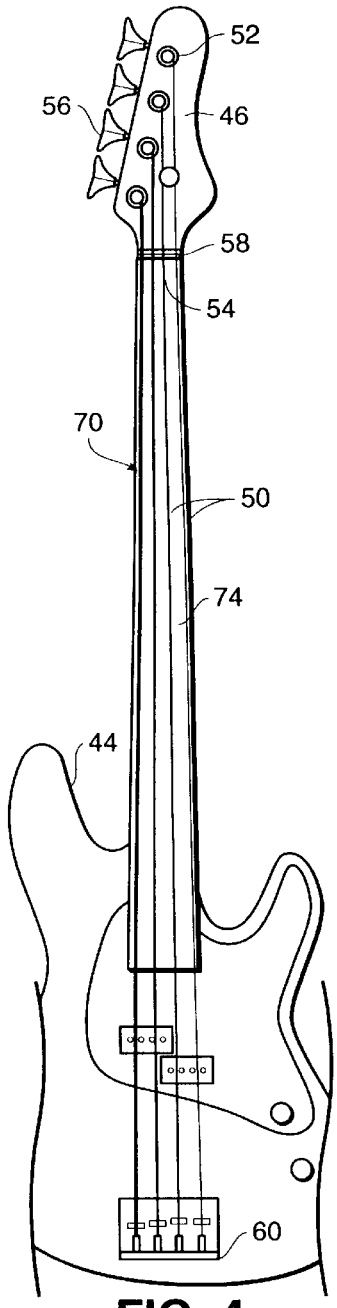
Figure 5:
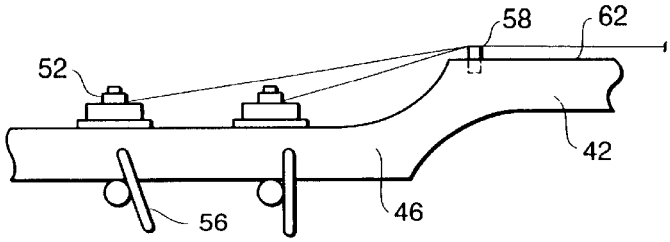
Figure 6:
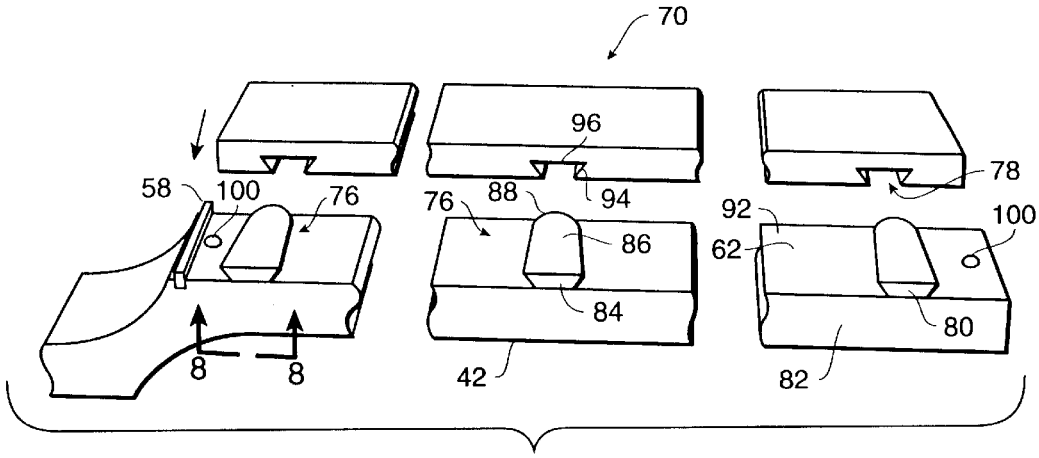
Figure 7:
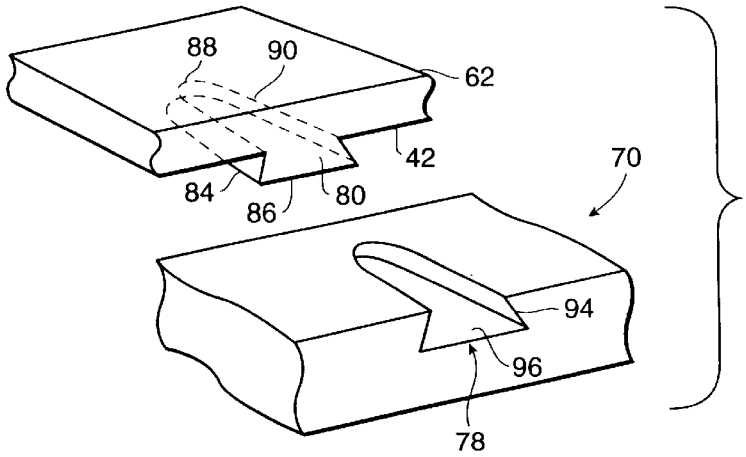
Figure 8:
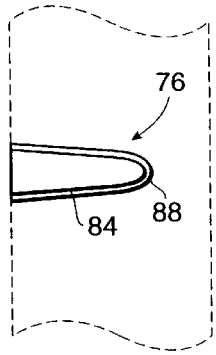
Figure 9:
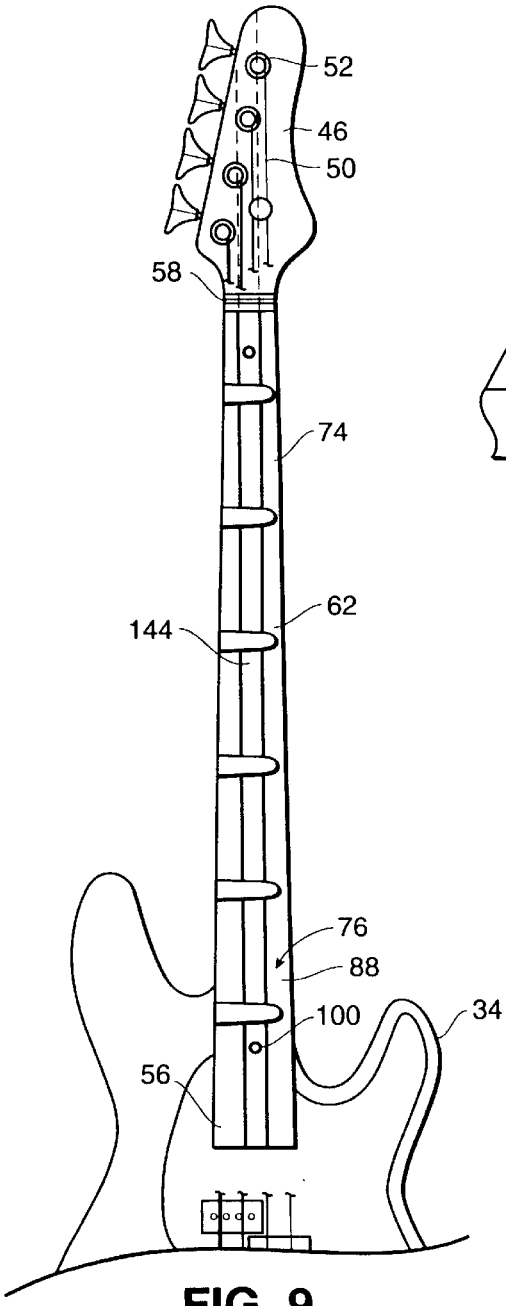
Figure 10:
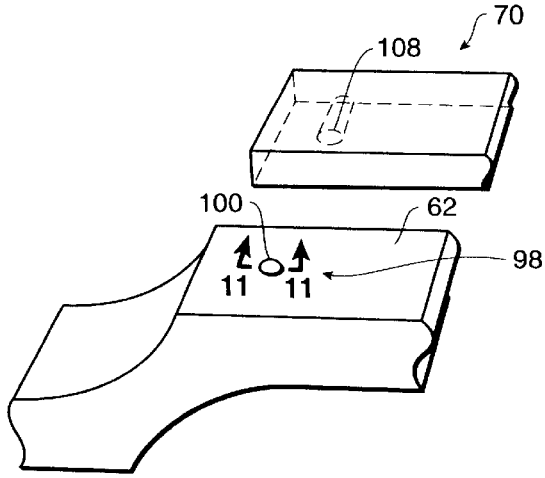
Figure 11:
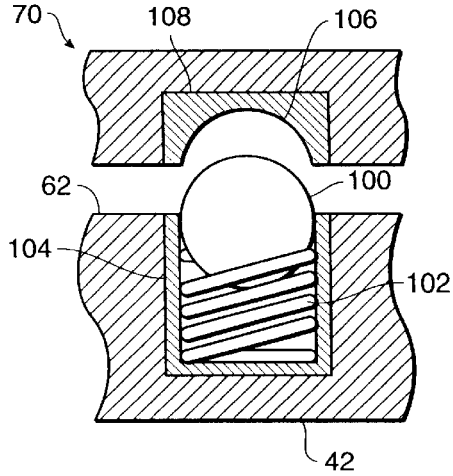
Figure 12:
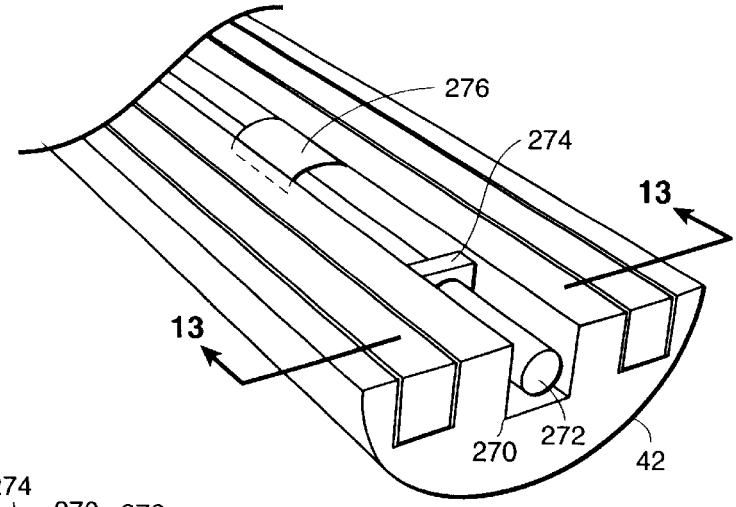
Figure 13:
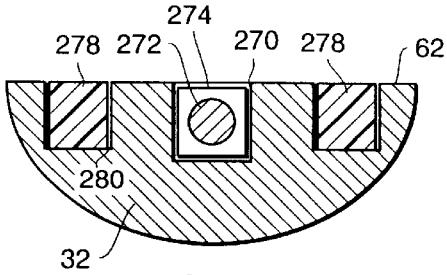
Figure 14:
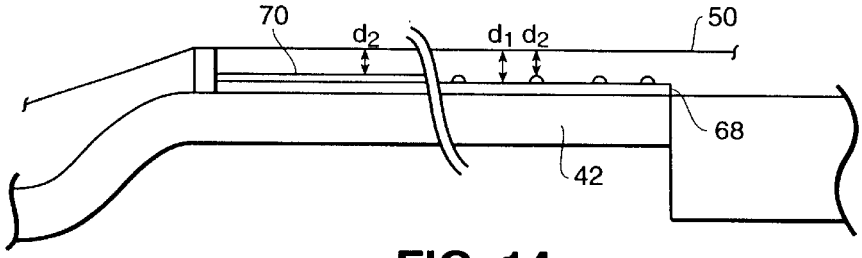
Figure 16:
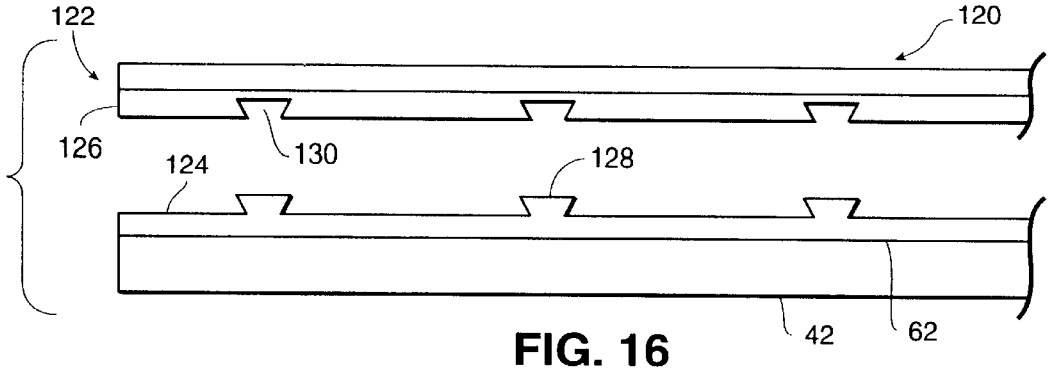
Figure 15:
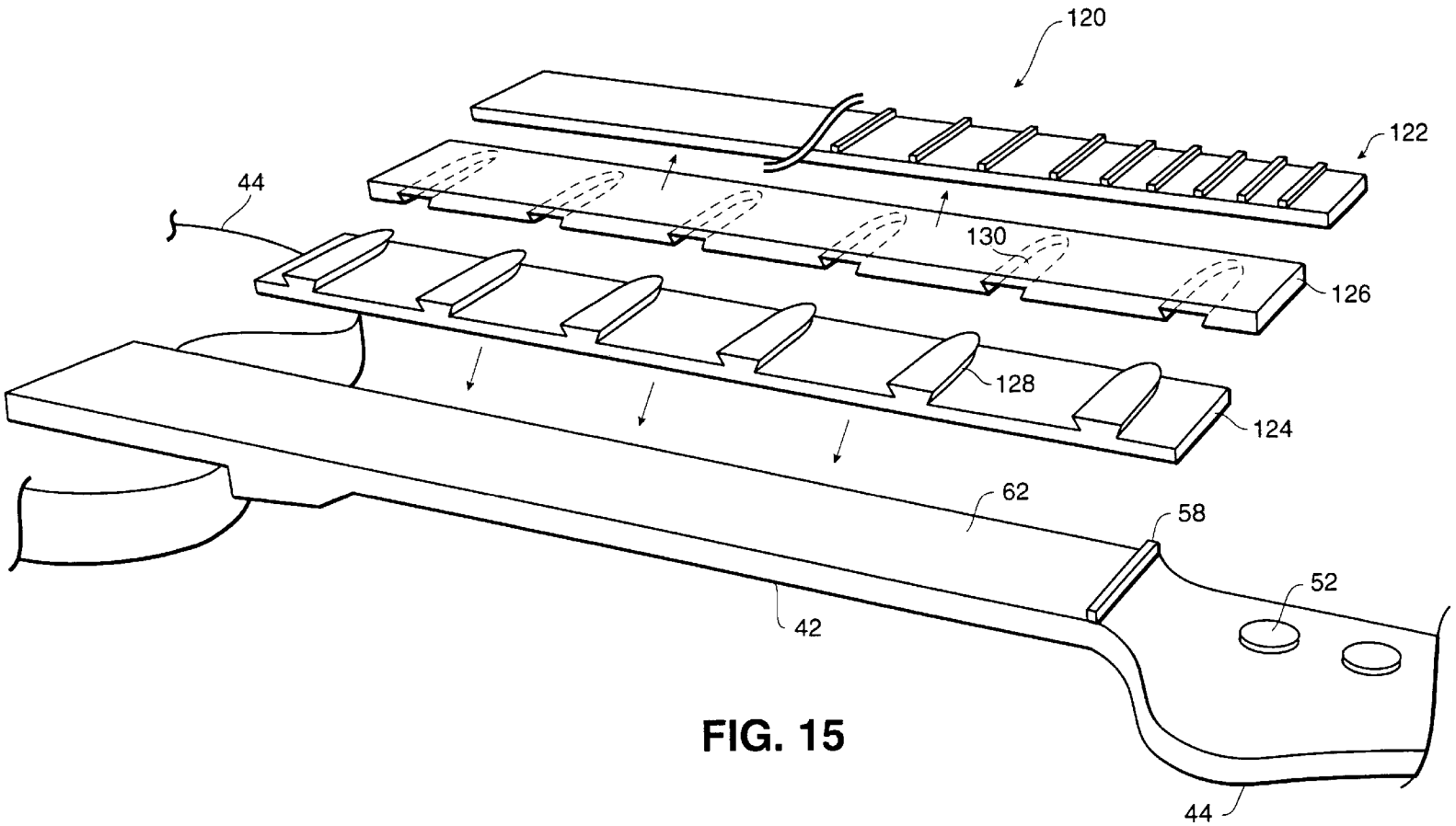
Figure 17:
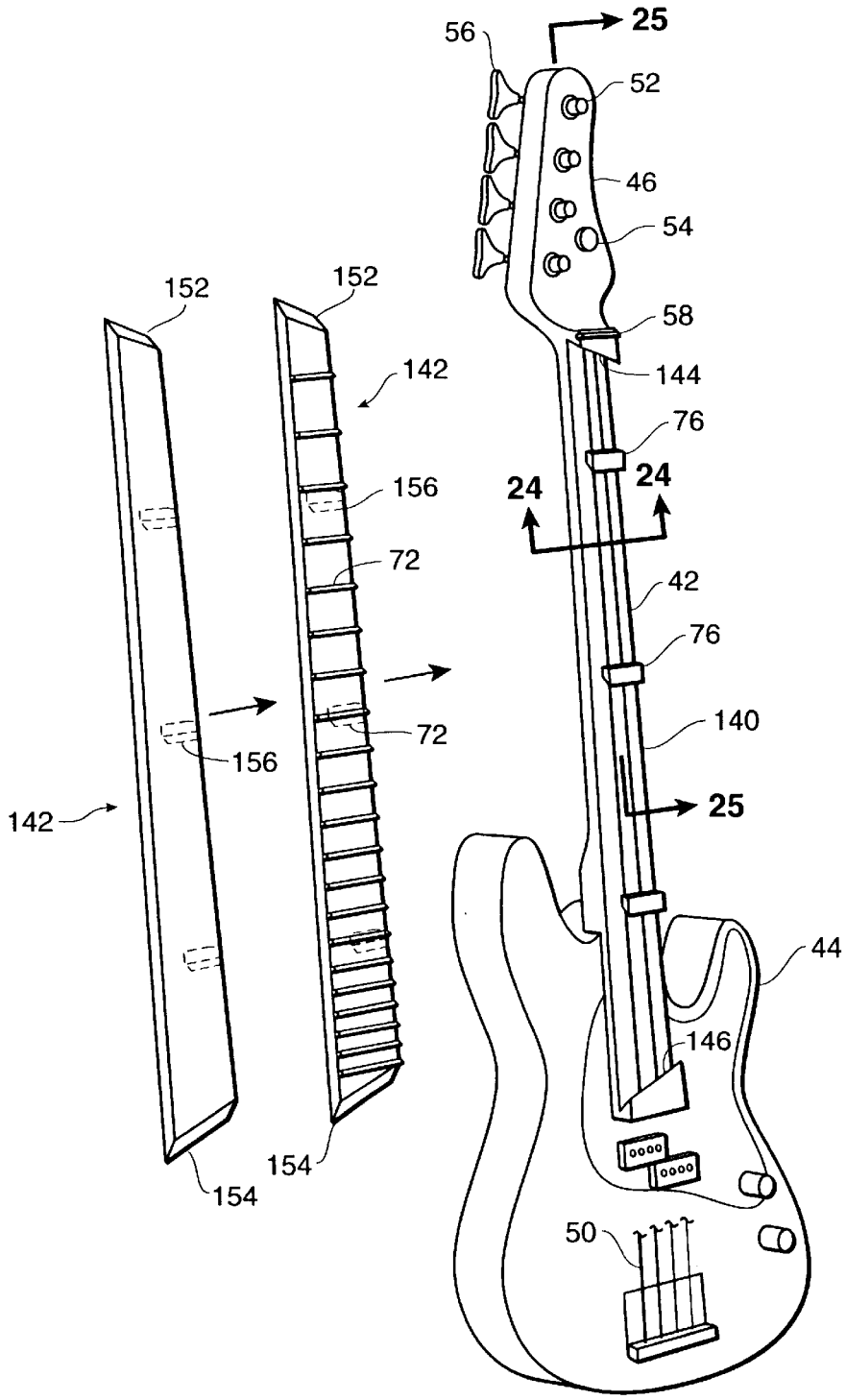
Figure 18:
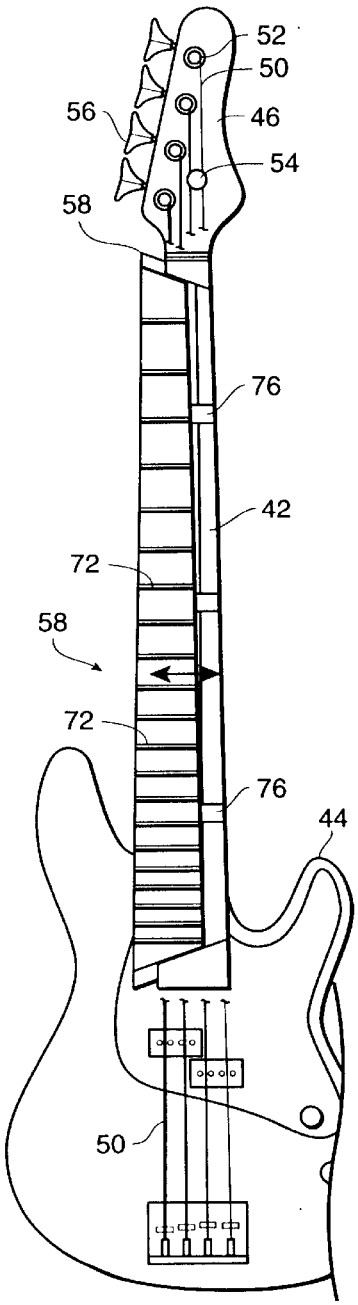
Figure 19:
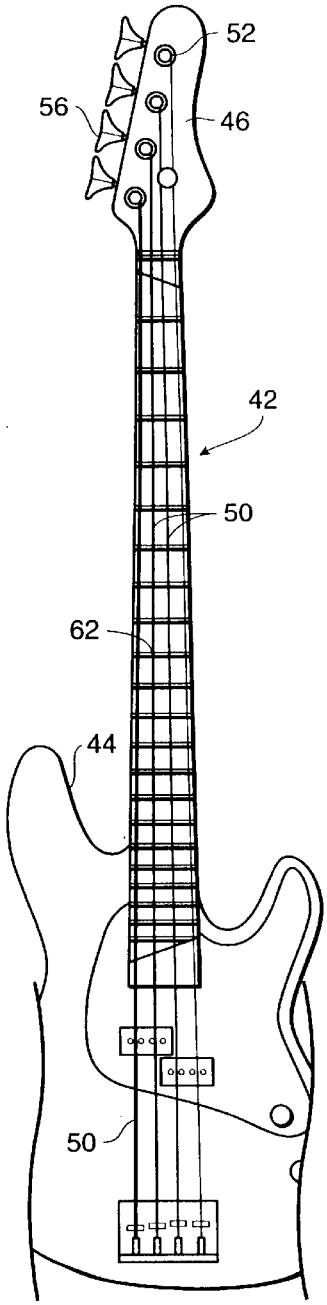
Figure 20:
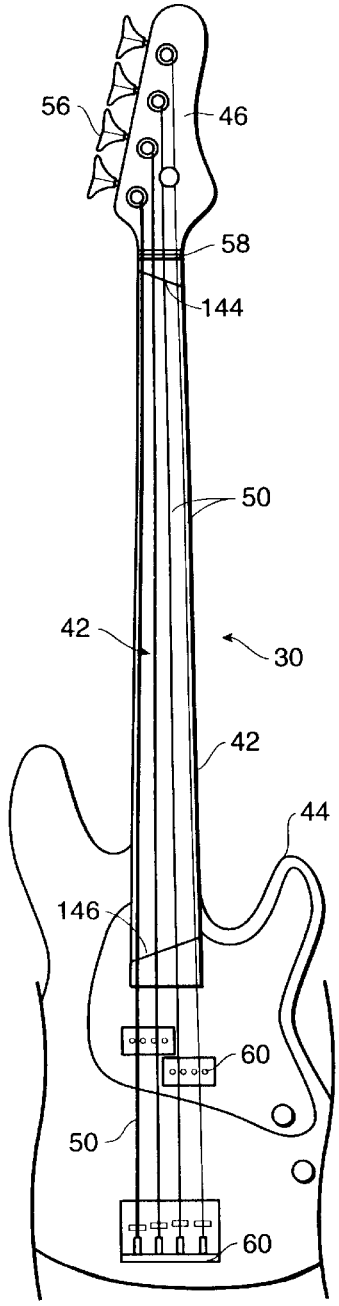
Figure 21:
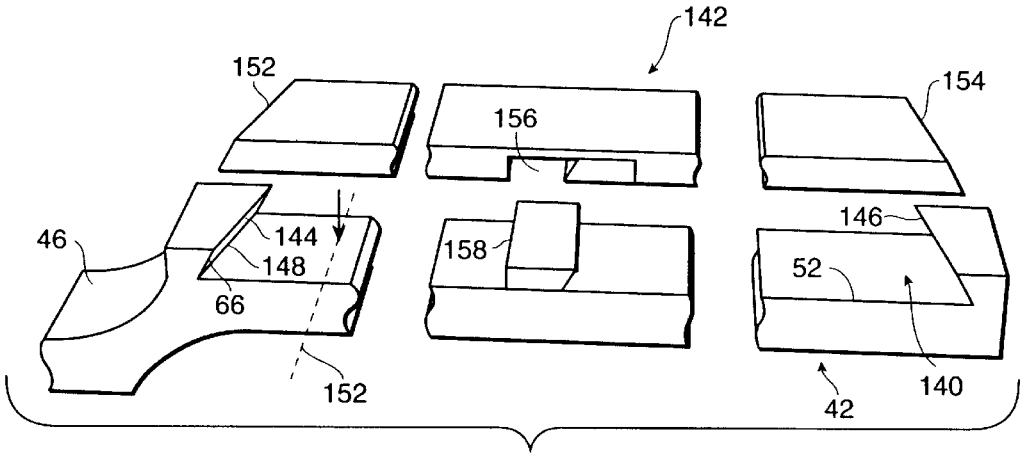
Figure 22:
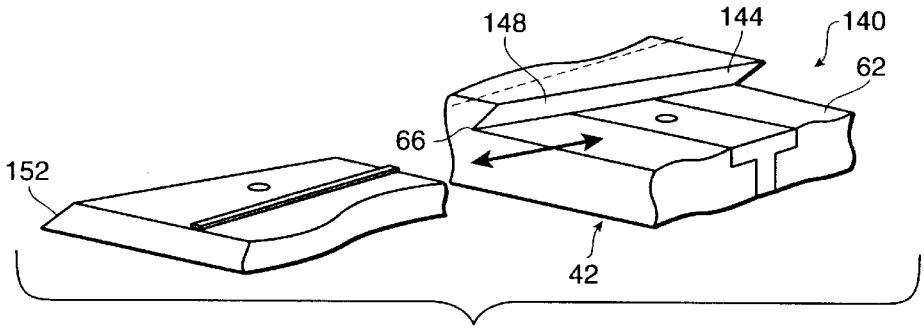
Figure 23:
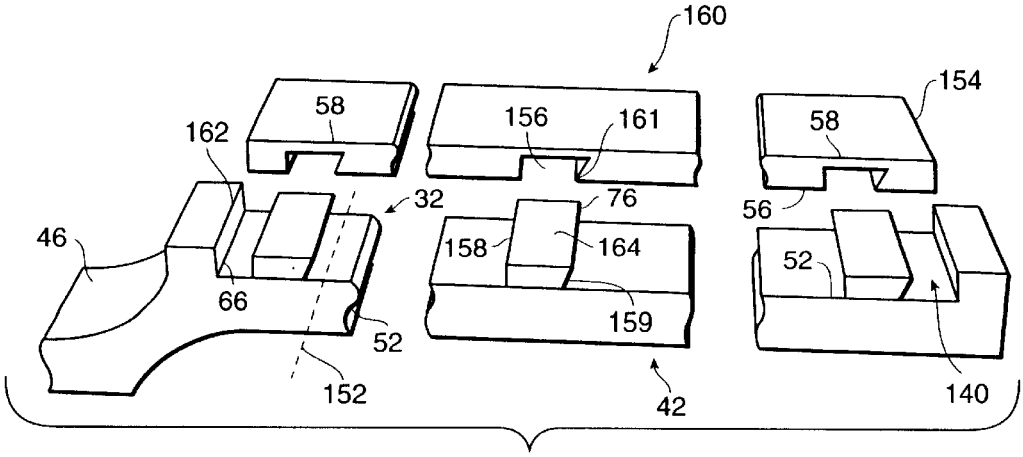
Figure 24:
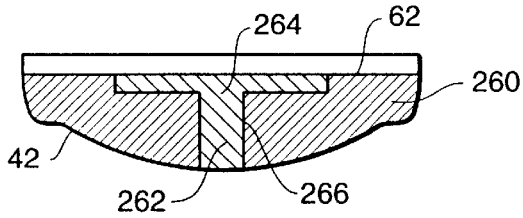
Figure 25:
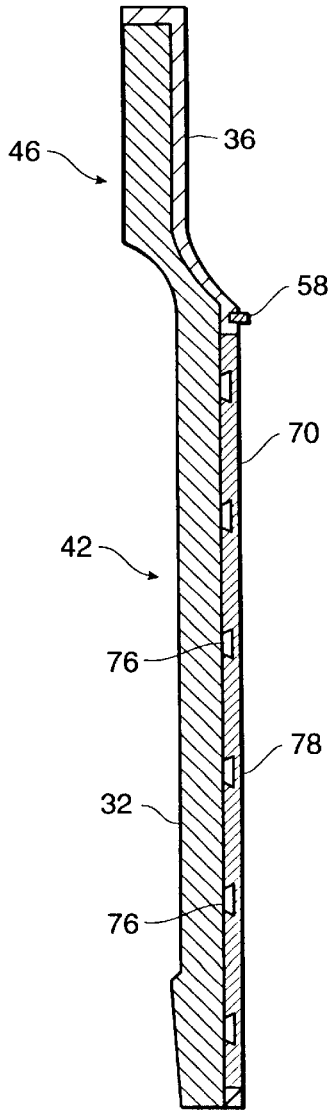
Figure 26:
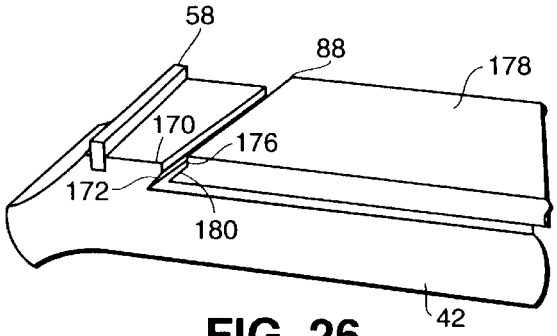
Figure 27:
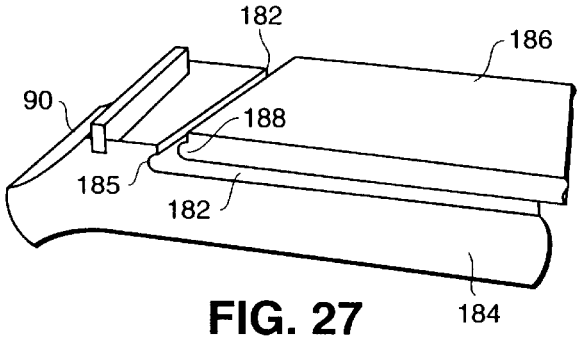
Figure 28:
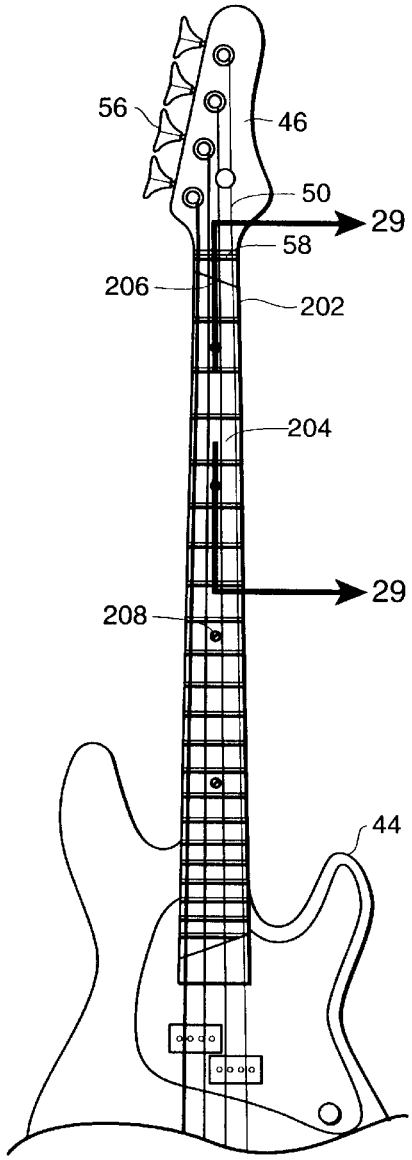
Figure 29:
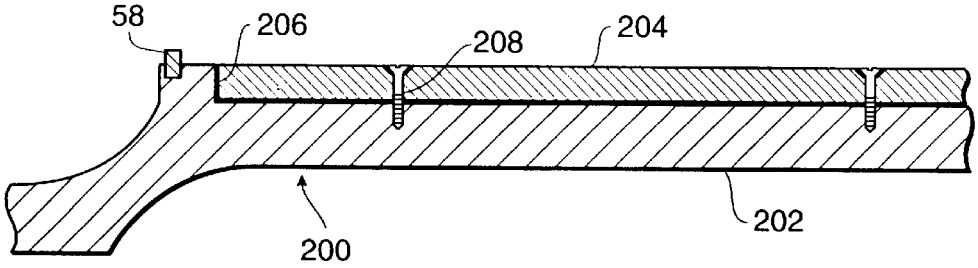
Figure 30:
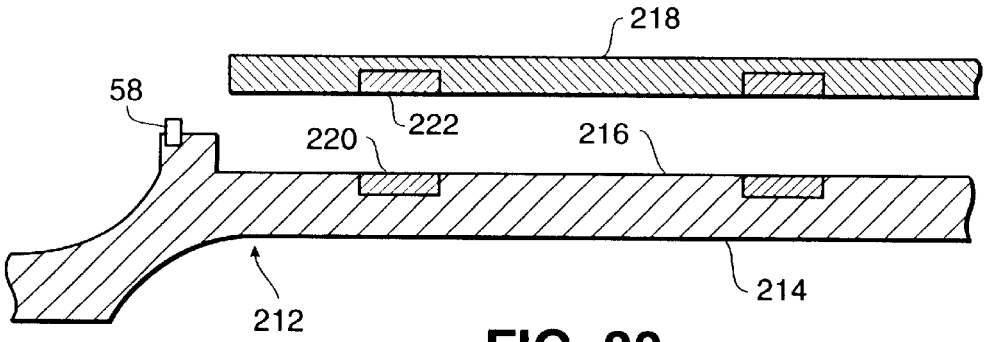
Figure 31:
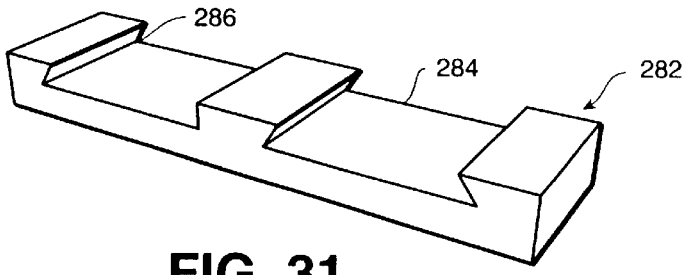

Having thus described the invention in general terms, reference will now be made to the accompanying drawings (six sheets) in which:

FIG. 1 is an exploded perspective view of a stringed musical instrument constructed in accordance with and embodying the present invention;

FIG. 2 is a fragmentary top plan view of the stringed musical instrument of FIG. 1 and showing a removable fingerboard in a position where it is being mounted on or removed from the neck of the musical instrument;

FIG. 3 is a fragmentary top plan view of the musical instrument of FIG. 1, similar to FIG. 2, and showing a fretted fingerboard mounted on the musical instrument in accordance with the present invention;

FIG. 4 is a fragmentary top plan view of the musical instrument of FIG. 1, similar to FIGS. 2 and 3, and showing a non-fretted fingerboard mounted on the neck of the musical instrument;

FIG. 5 is a fragmentary side elevational view of the head of the musical instrument of FIG. 1 showing the mounting of strings thereon;

FIG. 6 is a fragmentary perspective view of the musical instrument of the invention with a fingerboard removed therefrom and showing a preferred locking arrangement for mounting the fingerboard to the musical instrument;

FIG. 7 is a fragmentary perspective view of the underside of one of the grooves which are sized to receive a locking element forming part of the locking arrangement of FIG. 6 on the neck of a musical instrument;

FIG. 8 is a sectional view looking upwardly and showing the underside of one of the locking elements and being taken substantially along line 8—8 of FIG. 6;

FIG. 9 is a fragmentary top plan view of the musical instrument of FIG. 1 and showing locking features for removable interlocking of the fingerboards to the neck of the musical instrument;

FIG. 10 is a fragmentary perspective view showing a second form of locking means for holding a fingerboard in a marginally aligned position on the neck of the musical instrument of FIG. 1;

FIG. 11 is a fragmentary sectional view taken along line 11—11 of FIG. 10;

FIG. 12 is a fragmentary perspective view showing a preferred form of reinforcing the neck of the musical instrument of FIG. 1, in accordance with the present invention;

FIG. 13 is a sectional view taken along line 13—13 of FIG. 12;

FIG. 14 is a schematic view showing the positioning of a fretted and a non-fretted fingerboard in the neck of the musical instrument to compensate for differences in thicknesses thereof:

FIG. 15 is a fragmentary exploded perspective view showing a preferred fingerboard construction in which interlocking elements for holding the fingerboards onto the neck of a musical instrument are separately formed on individual plates;

FIG. 16 is an exploded side elevational view of the components forming part of the fingerboard assembly of FIG. 15;

FIG. 17 is an exploded perspective view of a modified form of musical instrument and removable fingerboard construction using a different mounting means for holding a fingerboard on the neck of a musical instrument;

FIG. 18 is a fragmentary top plan view, similar to FIG. 2, and showing the sliding of a modified form of fingerboard into the neck of the musical instrument of FIG. 17;

FIG. 19 is a fragmentary top plan view, similar to FIG. 3, and showing the modified form of fretted fingerboard on the neck of the musical instrument of FIG. 17;

FIG. 20 is a fragmentary top plan view, similar to FIG. 4, and showing a non-fretted fingerboard on the neck of the musical instrument of FIG. 17;

FIG. 21 is an exploded fragmentary perspective view showing a double bevel groove construction forming part of the locking elements in the musical instrument of FIG. 17 for mounting a fingerboard to a neck of the musical instrument of FIG. 17;

FIG. 22 is a fragmentary exploded perspective view, and showing the mounting of the fingerboard in FIG. 17 to the neck of a musical instrument employing a double bevel edge in a groove formed in the neck of the instrument;

FIG. 23 is an exploded fragmentary perspective view showing another means for mounting of a fingerboard to the neck of the musical instrument;

FIG. 24 is a sectional view taken along line 24—24 of FIG. 17;

FIG. 25 is a sectional view taken along line 25—25 of FIG. 17;

FIG. 26 is a fragmentary perspective view of another modified form of mounting means for mounting a fingerboard to the neck of a musical instrument;

FIG. 27 is a fragmentary perspective view of a further modified mounting means for mounting a fingerboard to the neck of a musical instrument;

FIG. 28 is a fragmentary top plan view showing another modified form of mounting a fingerboard to the neck of a musical instrument using screws therefor;

FIG. 29 is a fragmentary sectional view taken along lines 29—29 of FIG. 28;

FIG. 30 is a exploded fragmentary sectional view showing a magnetic means for releasably mounting a fingerboard to the neck of a musical instrument in accordance with the present invention; and FIG. 31 is a perspective view of a retaining member for holding a fingerboard of the present invention when not used on a musical instrument.

DETAILED DESCRIPTION OF A PREFERRED EMBODIMENTS

Referring now in more detail and by reference characters to the drawings, which illustrate preferred embodiments of the present invention, reference numeral 40 represents a stringed musical instrument which has interchangeable fingerboards, as hereinafter described. In particular, the invention primarily relies upon the substitutability of a fretted fingerboard for a non-fretted fingerboard on the same musical instrument. For purposes of describing the present invention, a guitar has been illustrated in the drawings, although it should be understood that any of the stringed musical instruments of the type previously described could be constructed with the interchangeable fingerboard construction of the invention.

The musical instrument 40 generally comprises an elongate neck 42 having a body 44 at one end and a head 46 at the opposite end. A plurality of wires, commonly referred to as "strings" 50 are secured to pins 52 on the head 46 and trained around guide posts 54 for extension over and along the neck of the musical instrument and the body 44. These strings 50 are tunable by means of tuning knobs 56 connected to the pins 52 in a conventional manner. At their opposite ends, the strings 50 are secured to the body of the musical instrument, also in a conventional fashion.

The actual construction of the head 46 and the components thereon, as well as the body 44, is conventional and therefore is neither illustrated nor described in any further detail herein. In this respect, the invention, as described herein, is equally applicable to both non-electrical stringed musical instruments and electrical versions of these musical instruments. Insofar as the present invention is concerned, either version would operate in the same way.

The strings 50 of the musical instrument are extended over and trained against a transversely extending protrusion 58 at the region of joinder of the neck 42 to the head 46 and which is typically referred to as a "nut". In this respect, the strings 50 have been broken away or eliminated in some of the drawing figures, for purposes of clarity. At its right-hand end, that is, adjacent the body 44, the musical instrument is provided with another transverse upwardly extending projecting element or so-called "protrusion" 60 typically referred to as the "bridge".

The principle underlying reasons why the present invention provides an effective means for substituting a fretted fingerboard for a non-fretted fingerboard, and vice versa, relies on a combination of several unique features, as hereinafter described in more detail. These features include, for example, and are primarily responsible for the fact that a fingerboard can be removed very quickly and easily without any binding on the neck of the musical instrument and a new fingerboard inserted in its place without undue attention by the musician and, moreover, in a very quick time period in a musical performance. Thus, it is this combination of features which give rise to the effectiveness and the actual utility in substituting a fretted fingerboard for a non-fretted fingerboard and vise versa.

The major factors which give rise to this unique ability is the fact that there are preferably two different types of interlocking elements for locking the fingerboard to the neck of the musical instrument. In one case, beveled projections fits within beveled grooves which serve as intermediate locking elements and rely upon end locking elements which utilize a spring bias ball fitting in a detent or similar arrangement. These end locking elements actually cooperate with the intermediate locking elements so that each enable a tight fitting positioning of the fingerboard on the neck of the musical instrument and also allows quick removal therefrom. Another one of these features that gives rise to this advantage is the fact that the interlocking elements are not only provided with a dovetail construction, this dovetail construction exists almost entirely around the interlocking surfaces of the fingerboard and the neck of the musical instrument. The tapered aspect of the interlocking elements allows easy insertion of the board onto the interlocking elements and, when fitted thereon, is tightly retained on the neck of the musical instrument.

The applicant has also found that it is critical to use only a selected number of these intermediate locking elements. When the proper number of interlocking elements are used, the fingerboard does not restrain the normal flexibility of the neck and, moreover, does not vibrate independently of the neck of the musical instrument. In addition, the applicant has also found that the distance that the string is pushed downwardly to engage a surface of a fingerboard is always the same with the fretted fingerboard or with the non-fretted fingerboard. All of the above features operate in concert to enable this interchangeability of fretted for non-fretted fingerboards and, without these unique features, the fingerboards would not be interchangeable for one another with the same degree of effectiveness.

The above description of the musical instrument is applicable to essentially all of the embodiments of the musical instrument in accordance with the present invention. Several different mounting means for removably mounting the fretted and non-fretted fingerboards on the neck of the musical instrument are hereinafter described A. Fingerboard Mounting Means Using Dovetail Locking Elements and End Locking Elements By reference to FIG. 1, it can be seen that the neck 42 is not presently shown with a fingerboard on its upper surface 62. The nut 58 and the opposite end of the neck define opposite edges 64 and 66 in proximity respectively to the head 46 and in proximity to the body 44, respectively, and which defines the length of a fingerboard to be fitted on the upper surface 62. Due to the fact that there is no fingerboard presently located on the neck, as shown in FIG. 1, the overall thickness of the neck is less than it would otherwise be when a fingerboard is fixedly mounted on that neck. In addition, and although the major portion of the length of the neck is of reduced thickness to accommodate a removable fingerboard, as hereinafter described, the neck could have a reinforcing member located therein, in a manner to be hereinafter described in more detail.

Removably mounted on the upper surface 62 of the neck 42 is either a fingerboard 68 or a fingerboard 70. The fingerboard 68 is provided with a plurality of upstanding protrusions 72 or so-called "frets" extending transversely across the fingerboard, as shown in FIGS. 1, 2 and 3. In this way, a player of the musical instrument can effectively modify the length of the strings between the point where the musician engages the strings on a selected fret 72 and the bridge 60. The fingerboard 70 is provided with a relatively smooth upper surface, as shown in FIGS. 1 and 4, and, therefore, constitutes a non-fretted fingerboard.

When the fingerboards 68 or 70 are located on the upper surface 62 of the neck 42, the fingerboards will precisely marginally align with the edge of the nut 58 and the transverse edge of the neck 66. If the neck was provided with an elongate recess, as in a following described embodiment, then the fingerboards would be provided with a length so as to properly fit within the length of that recess.

By reference to FIG. 2, it can be observed that a fretted fingerboard, such as the fingerboard 68, is being slid onto the neck 42 from one longitudinal side thereof. FIG. 3 illustrates that fingerboard 68 fully located on the neck 42. FIG. 4 illustrates the same musical instrument with a fretless fingerboard substituted in place of the fretted fingerboard. In each case, the fretted fingerboard can be very readily and easily removed and the fretless fingerboard inserted in its place and vice versa. There is no need for the musician to engage with mechanical fasteners or the like. Accordingly, the musician can alter the musical instrument to obtain a fretted musical instrument or a fretless musical instrument merely by changing fingerboards and without requiring any readjustment or re-tuning of the musical instrument.

By reference to FIG. 1, it can be seen that the fretted fingerboard 68 is provided with a plurality of longitudinally spaced apart generally transversely extending upstanding frets 72. The size and spacing of the frets is essentially conventional and in accordance with the standard practices normally adopted in stringed musical instruments. The fretless fingerboard 70 is provided with a relatively flat upper surface 74.

Various means for removably mounting the fingerboards 68 or 70 to the neck 42 are provided. One of the preferred means for removably mounting the fingerboards is more fully illustrated in FIGS. 1, 6–11 of the drawings. This mounting means relies upon two differing types of interlocking elements which include end locking elements and intermediate locking elements. The intermediate locking elements are more fully shown in FIGS. 6–9 of the drawings and comprises individual upstanding protrusions 76 which function as locking elements and which are longitudinally spaced apart across the length of the neck 42. These locking elements 76 cooperate with cooperating locking elements in the form of grooves 78 on the underside of the fingerboard, such as the fretless fingerboard 70, as shown in FIG. 6 and 7. In this respect, the same construction used for locking the fretless fingerboard onto the neck will be used for locking fretted fingerboard onto the neck. The projections 76 extend transversely across the neck 42, as best shown in FIGS. 6–8 of the drawings. In like manner, the grooves 78 are aligned with each of the individual projections 76 and also extend transversely across the fingerboard. In this respect, it should be understood that the projections could be mounted on the underside of the fingerboards to mate with corresponding grooves formed on the upper surface of the neck 42.

It should also be observed in connection with FIGS. 7 and 8 that the projections 76 and the corresponding recesses do not extend for the full transverse dimension across the neck 42 and the fingerboard, respectively. Rather, they terminate inwardly of one longitudinal edge thereof. In this way, when the fingerboard is slid onto the neck 42 from one longitudinal side thereof, the longitudinal registration of the fingerboard with the neck of the musical instrument is readily obtained. However, it is important that at least the grooves 78 open on one longitudinal side of the fingerboard. In like manner, the projections should preferably have end faces 80 which are contiguous with one outer longitudinal edge 82 of the neck 42, as shown in FIG. 6.

The locking element projections 76 are each formed with beveled side walls 84 and which are beveled so that the side walls 84 converge downwardly toward one another. Moreover, the projections 76 are provided with flat upper surfaces 86. The side walls 84 also converge from one transverse end toward the other and toward one another at an arcuate end face 77. In this way, the projections 76 are tapered slightly but continuously from the end face 80 to the arcuate end face 88 and, in effect, from the longitudinal edge 82 toward the opposite longitudinal edge 92 thereof, forming a dovetail construction, as shown in FIGS. 6–8.

The grooves 78 are similarly formed so as to snugly, but nevertheless, removably accommodate each of the locking projections 76. Each groove 78 is similarly formed with inner transversely extending, upwardly and outwardly diverging beveled walls 94 and connected by a flat top wall 96. In effect, each of the projections 76 and the grooves 78 are formed with a dovetail construction. In this way, the projections become firmly, but nevertheless, removably locked within the grooves 78 merely by sliding the fingerboard onto the musical instrument. Moreover, there is a positive locking action around the entire periphery of each projection with the exception of one end face 80.

When the fingerboard is slid off of the musical instrument in the opposite direction, the protrusions 76 will become easily and readily removed from the grooves 78. The fact that the locking projections and matching grooves are tapered from one longitudinal side toward the opposite longitudinal side with respect to the neck 42, facilitates the entrance of the projections 76 into the grooves 78. In this way, there is no need for precise alignment. The actual arcuate edges of the projections also facilitate the entry of the projections into the grooves 78. Moreover, the fact that the projections 76 are tapered toward the arcuate ends 88 also enables easy entry of these projections into the grooves.

It can be observed, by reference to FIGS. 6–8, that there is an actual interlocking of the neck to the musical instrument completely around the edge of the projections 76 and the corresponding grooves 78. Thus, a locking action occurs even at the transverse end with the edge 88. Moreover, the fact that the arcuate end 88 will abut against the corresponding end of the groove also provides precisely marginal registration of the fingerboard on the neck of the musical instrument.

In addition to the foregoing, it is quite important to insure that the fingerboard does not flex independently of the nect. This cosnideration is also coupled with the fact that the normal bowing of the neck makes it difficult to mount a relatively straight fingerboard thereon when there are not a precise number of intemediate locking elements. In addition, the normal flexing of the neck of the musical instrument and any fingerboard mounted thereon must not be inhibited. In the aforesaid U.S. Pat. No. 4,132,143 to Stone, the instrument, as shown, employs too many locking elements which are spaced too close to one another and which thereby makes the attachment of the fingerboard to the neck of the musical instrument quite difficult, if not impossible. In addition, the normal flexing, which would otherwise occur, cannot be destroyed. Any interference with normal flexing has a deleterious effect on the quality of the music thus generated. It has been found in connection with the present invention that there should be no more than a total of six interlocking elements not including the two end locking elements, as hereinafter described. Otherwise, normal flexing is reduced, thereby also reducing the quality of the music. It has been found in connection with the present invention that there should be no less than four and no more than seven intermediate locking elements for a normal neck length of approximately 24 inches to 26 inches. This will provide the required amount of normal flexing and will still nevertheless maintain the fingerboard on the neck of the instrument and will preclude vibration of the fingerboard independently of the neck.

It is also important to note that the fingerboard extends almost entirely for the full length from the nut 58 to the point of termination of the fingerboard at the body 44. In other words, there is no groove formed in the neck of the musical instrument. As a result, there is no ridge or valley at the end adjacent the nut and, moreover, the playing surface of the instrument is maintained at the same height for the full length of the fingerboard.

The present invention also utilizes a differing type of end locking element 98, as best shown in FIGS. 10 and 11 of the drawings. This end locking element 98 provides for precise marginal alignment of the edge of the fingerboard with the edge of the neck of the musical instrument and in addition provides cooperating action with respect to the previously described locking elements 76 and 78.

The end locking elements, in a preferred embodiment, may adopt the form of a spring biased locking ball and detent arrangement.

Thus, a spring biased ball 100, which is biased upwardly by the means of a spring 102, located within a canister 104 fitted within the upper surface 62 of the neck 42, would be biased upwardly into a detent 106 located in the downwardly presented surface of the fingerboard. In this case, a brass strip 108 can be mounted on the underside of each of the fingerboards and which is provided with this detent 106 for receiving the spring biased ball 100. Thus, when the fingerboard is slid into position on the neck of the musical instrument, the ball 100 will seat within the detent 106 and thereby releasably lock the fingerboard into position.

From the standpoint of the musician who is inserting a fingerboard on the neck of the musical instrument, when the fingerboard has reached the limit of transverse movement, the musician will hear the click of the biased ball moving into the detent and will know that the fingerboard is precisely mounted in place.

It can be seen that the ball and detent arrangement provides not only the marginal alignment of the fingerboard on the neck of the musical instrument, but it only provides an upward biasing force to the fingerboard. This causes the locking protrusions 76 to be forced into tighter engagement with the cooperating locking grooves 78. In this way, the two types of locking elements cooperate with one another. However, it should be recognized that other end locking means which provide an upwardly biasing force to the fingerboard could be used and including, for example, spring clips and the like.

The tapered shape of the interlocking elements also not only makes it easy to insert these interlocking projections into the grooves, but the taper all the way around provides a very effective locking action. Moreover, since the walls are tapered from one longitudinal side toward the opposite longitudinal side, that is, tapered in the transverse dimension, the projections very easily and readily enter into the grooves and the locking action only takes place during the latter part of the movement of the fingerboard onto the neck of the instrument. This type of dovetail construction precludes all upward motion independently of the neck of the instrument. In effect, the intermediate locking elements preclude uplifting movement of the fingerboard and the ball and detent arrangement precludes any transverse shifting movement of the fingerboard when locked into position.

As indicated previously, it is important to insure that the distance any string is moved to contact another surface is precisely the same whether that surface is on a fretted or no fretted fingerboard. Otherwise, instrument adjustment problems will arise. By reference to FIG. 14, it can be observed that a fingerboard, such as a fretted fingerboard 68, is schematically illustrated as being mounted on the neck 42 of a musical instrument. It can be observed that the distance from the upper surface of that fingerboard 68 to the strings 50 is a distance dl. In like manner, the distance from the upper surface of any of the frets 72 to the strings 50 is a distance $d_2$. Thus the distance that the strings 50 is moved downwardly to contact the surface on a fretted fingerboard is that distance $d_2$. Inasmuch as the fretless fingerboard 70 is not provided with any frets, the thickness of that board is such that the distance between the upper surface of the fingerboard 70 and the strings 50 is also $d_2$. Thus, the fretless fingerboard has an overall thickness which is equal to the thickness of the fretted fingerboard plus the overall height of the frets 72 thereon.

FIGS. 15 and 16 illustrate an embodiment of the invention which is highly effective for manufacturing with precise tolerances. In connection with this embodiment as well as the other following embodiments of the invention, like reference numerals will be used to represent like components.

In accordance with the modified form of stringed musical instrument, designated by reference numeral 120 in FIGS. 15 and 16, the same construction of the instrument is used, as in the case of the musical instrument 40 previously described, except for the fact that the locking elements in the form of protrusions 76 are not formed on the upper surface 62 of the neck 42. In like manner, no corresponding locking elements are formed on the underside of modified forms of fingerboards 122 which may be employed. Thus, the upper surface 62 of the neck 42 is generally flat, as shown in FIG. 15.

The locking arrangement between the fingerboard and the neck of the musical instrument is actually provided by thin plates 124 and 126 which are respectively secured to the upper surface 62 of the neck 42 and the underside of each of the fingerboards 122. In this particular embodiment, the upstanding projections which were previously formed on the upper surface of the neck 42 are now formed on the upper surface of the plate 124. In like manner, the grooves or notches 78 which were formed on the underside of the fingerboards 68 and 70 are now formed on the underside of the plate 126, much in the same manner as they were previously formed. Further, the plate 124 is secured to the upper surface 62 of the neck 42 and the plate 126 is secured to the underside of the fingerboard 122, e.g. by adhesive or the like.

This embodiment of the invention is highly effective in that the two plates 124 and 126 can actually be injection molded or otherwise formed in conventional woodworking operations. Durable rigid plastics, such as polypropylene, can be used for this purpose. The entire plate assembly comprises the plates 124 and 126 which can be molded or otherwise formed with a high degree of precision to provide those tolerances necessary for a good interlocking fit of the projections in the grooves. In addition, the precise alignment between the projections and the grooves which are obtainable in a machining operation, for example, allows an ease of interfitting the projections in the grooves. In this respect, the actual shape of the projections 128 and the shape of the grooves 130, along with their respective positioning, is identical to that shown in the arrangement of FIG. 1. The use of the plates 124 and 126, however, facilitates manufacturing and reduces the overall cost thereof.

It may be appreciated that the neck of the musical instrument may suffer reduced ability to withstand bending moment forces imposed on the neck because of the removal of material in that region. This is particularly the case, since the neck of the musical instrument in actual use is frequently subjected to bending moment forces. In addition, string tension will tend to create deformation of the neck.

In many stringed musical instruments having an elongate neck, such as a bass guitar, a tensioning rod is often provided. The tensioning rod is introduced into an elongate groove or trough formed in the recess itself. FIGS. 12 and 13 illustrate an elongate longitudinally extending trough 270 in the neck 42. Located in this trough 270 is a tensioning rod 272 and which is threaded through a plurality of nuts 274 fixedly mounted within the trough 270. In this way, turning of the tensioning rod 272 by a suitable tool will allow for an imposition of a desired amount of tension or compression on the neck of the musical instrument. The trough may further be provided with filler blocks 276 in order to provide an upper surface contiguous with the surface of the recess 268, all as best shown in FIGS. 31 and 32.

In the embodiment of the invention as also shown in FIGS. 12 and 13, it is possible to provide additional reinforcing strips as, for example, reinforced plastic composite strips 278 and which are also located in rectangularly shaped troughs 280. In this case, the strips 278 are of rectangular cross-sectional construction and fit snugly within the troughs 280. These reinforcing strips may be formed of any typical reinforced plastic composite materials as, for example, those materials mentioned above.

B. Mounting a Fingerboard in a Recess on the Neck of the Musical Instrument with Beveled Locking Elements Another means for removably mounting a fingerboard to the neck of a musical instrument is illustrated in FIGS. 17–22 of the drawings. In this case, the neck 42 of the instrument is provided with an elongate recess 140 which is sized to receive a fingerboard 142 and the latter of which may also be a fretted or non-fretted fingerboard. Thus, it can be observed that end sections of the fingerboard are physically and permanently mounted on the neck of the musical instrument. As a result, the fingerboard literally fits within this recess 140. In this arrangement, fretted and non-fretted fingerboards may also be substitutable for one another.

In the embodiment of the invention, as best shown in FIGS. 17, 21 and 22, the fingerboards and the elongate recess 140 both rely upon bevel edges for holding the fingerboard within the recess formed in the neck of the musical instrument. Thus, the neck is cut with a groove or recess 140 extending for the major portion of the distance of the neck and having end edges 144 and 146, both cut with a double bevel.

Thus, by referring to FIGS. 17, 21 and 22, it can be seen that the left-hand edge 144 of the recess 140, adjacent the head 46, is under-cut to form a beveled edge which is progressively cut into the stock of the neck toward its lower end. Thus, the edge 144 tapers downwardly and outwardly to form a V-shaped notch 148. This notch 148 has a regular cross-section across its transverse dimension, but one transverse end is closer to the head 46 than the opposite transverse end. The opposite edge 146 is similarly provided with a V-shaped notch substantially similar to that shown at the edge 144, but being opposed to the notch at the edge 144.

The edge 144 is also beveled transversely across the board, thereby providing a double bevel. In this case, the V-shaped notch is angularly located with respect to a transverse axis 150 across the width of the neck. It can be seen that the V-shaped notch 144 angles away from a transverse axis. The notch 146, at the opposite edge of the recess 140 would similarly have a double bevel and would also be angularly displaced from a transverse axis 150, but in the opposite direction, such that in space, the two notches 144 and 146 would intersect.

By further reference to FIGS. 17, 21 and 22, it can be seen that the transverse edges of the fingerboards, e.g., the fingerboard 142, are also provided with double beveled edges 152 and 154 to correspond to and mate with the edges 144 and 146, respectively. Thus, the left-hand edge of the fingerboard 142 is similarly tapered with a V-shaped projection size to fit within the notch 148 at the edge 144. In like manner, the right-hand end of the fingerboard is provided with a somewhat V-shaped projection to fit within the corresponding notch at the edge 146.

The underside of the fingerboard, e.g the fingerboard 142, are also provided with grooves 156 having shapes corresponding to upstanding intermediate locking elements 158, as best shown in FIGS. 17 and 21 of the drawings. Thus, the fingerboards are each provided with generally transversely extending grooves 156 sized to receive the upstanding locking elements 158. In this case, it can be observed that the upstanding locking elements 158 are only provided with a single bevel, that is, with a single beveled face 159 engaging a like single beveled face 161 in the groove 156. These beveled faces are not double beveled in the sense that they extend truly transversely across the width of the neck of the musical instrument.

It has been found in connection with the present invention that the angle of the taper of the edges 152 and 154 on the fingerboards are preferably at about 45°. However, it has been found that this angle can range from about 32° to about 61°. Naturally, the corresponding angle of taper of each notch 156 also would have an angle compatible with that of the angle of taper on the fingerboard edges. Thus, if the angle of taper is 40° for each of the edges of the fingerboard, then the corresponding angle of each of the notches should be 140°.

In order to compensate for the reduced thickness of the neck in the instrument of FIGS. 17–22, an elongate longitudinally extending reinforcing truss 260 is inserted into the neck and portions of the head and body, as shown in FIGS. 24 and 25. The truss in the embodiment as illustrated is T-shaped with a vertically arranged flange 262 and a horizontally arranged flange 264, the latter having its upper surface flush with the bottom of the groove formed in the neck of the musical instrument. The truss 260 itself is preferably formed of a strong structural material, such as steel or the like. The truss could be formed of other materials of construction, such as reinforced plastics, etc.

It is also possible to insert a tensioning rod 266 through the truss 264. The tensioning rod 266 also adds additional reinforcement and preferably extends from one end of the musical instrument to the other. Moreover, the tensioning rod 266 would have one or both ends external to the musical instrument. In this way, by turning nuts on the tensioning rod, the opposite ends of the instrument are effectively compressed and tension is provided on the instrument itself.

Although the truss 260 is T-shaped in the embodiment as illustrated, this truss could also adopt other beam shapes as, for example, an I-beam construction or the like. In some cases, if the neck of the musical instrument is formed of a reinforced plastic composite material, a longitudinal truss is not required. However, in most preferred constructions, the material of the neck is wood. If the truss is constructed of a hard wood, the truss can be laminated to the neck. However, the truss is preferably a metal, such as steel, aluminum, or the like. The truss itself may be a molded carbon fiber type reinforced plastic composite material.

Although the locking means of FIGS. 17–22 has been found to be a very effective means for locking the fingerboards within the elongate recess 140, other locking means which still afford a slidable shifting movement of the fingerboard onto and off of the neck 42 may also be provided. One of such systems is more fully illustrated in FIG. 23 of the drawings.

The embodiment of the invention shown in FIG. 23 is similar to that illustrated in FIGS. 17–22, except that in this particular embodiment, the edges of the recess 140 are relatively straight and, hence, parallel to a transverse axis 150. Thus, in the embodiment of FIGS. 17–22 the transverse ends 152 and 154 of the fingerboard 142 were each beveled, the transverse ends of the fingerboard 160, as shown in FIG. 22, is relatively rectangular and matches a rectangular face 162 at the edge of the recess 140. The same holds true with the intermediate locking elements 164. It has been found in connection with this particular embodiment, that where the end locking elements are located in closely spaced relationship to the ends of recess 140 that the actual double bevel construction is not necessarily required.

C. Other Fingerboard-Instrument Neck Interlocking Means

FIG. 26 illustrates an embodiment of the invention in which the elongate recess in the neck 42 of the musical instrument has end edges 170 provided with under-cuts forming notches 172. Edges 176 of fingerboards 178 are provided at their lower ends with transversely extending outwardly projecting tabs 180 which slidably fit within the notches 172. In this respect, while the notches 172 and the tabs 180 can be rectangularly shaped in cross-section, they may be provided with a bevel or inclined face across the transverse dimension of the fingerboards and the notch such that the fingerboards will come to rest in a marginally registered and aligned position with the neck of the musical instrument.

FIG. 27 illustrates a slightly modified form of tab and notch system in which the transverse edges of the groove 172 in a neck 184 are provided with somewhat of an arcuately-shaped notch 185. In this case, a fingerboard 186 having an outwardly extending somewhat arcuately-shaped tongue 188 is sized to fit within the notch 185, in the manner as best shown in FIG. 27. Again, both the tongue 188 and the notch 185 could be beveled from one longitudinal side of the neck toward the opposite longitudinal side in order to enable precise marginal registration of the fingerboard with the neck when the fingerboard has been shifted to its end position in the groove.

One means which avoids the need for precisely cut edge portions at the edges of the recess, are shown in FIGS. 28 and 29. In this case, a musical instrument 200 having an elongate neck 202 is provided with a removable fingerboard 204 having relatively flat transverse edges 206, as best shown in FIGS. 25 and 26. In this case, the fingerboard 204 is removably secured to the upper surface of the neck 202 by means of screws 208 which extend through the fingerboard 204 and into the neck 202. Moreover, and in the embodiment as illustrated, it can be seen that the heads of the screws are counter-sunk into the surface of the fingerboard 204.

In order to remove the fingerboard, it is necessary to remove the screws 108 and merely lift the fingerboard out of the recess formed in the neck of the musical instrument. In like manner, remounting of the fingerboard merely requires the insertion of the fingerboard into the recess and securement of same with the screws 208. Other forms of mechanical fasteners could also be used for this purpose.

FIG. 30 illustrates an embodiment of a musical instrument 212 having a neck 214 with a recess 216 formed therein to receive a removable fingerboard 218. In this embodiment, the neck is provided on its upper surface with magnets 220, and in like manner, the fingerboard is provided on its undersurface with magnets 222 generally in alignment with the magnets 220. In this way, in order to insert a fingerboard into the recess 216, it is only necessary to merely drop the fingerboard in the recess 216 and the magnets 220 and 222 will automatically couple providing removable locking action. Naturally, additional locking actions can be provided, if desired.

It should be understood, however, in connection with the present invention that the fretted fingerboard 68 could have depth which is slightly less than that of the fretless fingerboard 60 so that its upper surface is flat and contiguous with the remaining portion of the neck 42.

FIGS. 28 and 29 illustrate an embodiment in which a locking pin 244 can be inserted in the region of joinder of the neck to the head of the musical instrument, that is, the region identified as 246 in FIGS. 29 and 30. The pin 244 also extends longitudinally into the body of a fingerboard 248, as best shown in FIGS. 29 and 30. The pin 244 is designed for locking movement when pushed from the position as shown in the dotted lines of FIG. 29 to the position as shown in the solid lines of FIG. 29. When the pin is pulled to the rear, that is, to the dotted lines of FIG. 29, the fingerboard 248 can then be raised from its position on the neck of the musical instrument. By further reference to FIG. 29, it can be seen that the pin 244 extends beyond the opposite end of the musical instrument. Further, in FIG. 30, it can be seen that when the pin 244 is turned, an angularly projecting tab 250 on the pin 244 will be turned to lie in a locked position, as shown in FIG. 30.

The system of the present invention also uses a fingerboard retaining member or so-called "retaining blank" in order to preclude warpage of the fingerboard when not installed on the musical instrument. Thus, while one of the fingerboards, such as a fretted fingerboard, is installed on the musical instrument, the non-fretted fingerboard can be retained in a retaining blank 282, as best shown in FIG. 36 of the drawings. In this case, the retaining blank 282 would have an elongate recess 284 substantially identical to that recess formed on the neck of the musical instrument, such as that previously described. Thus, and for example, in the embodiment of the invention as shown in FIG. 36, the recess 284 has double-beveled ends 286 in order to conform to the tapered edges of the fingerboard. Naturally, it should be understood that if magnetic mounting means or other types of groove configurations are employed for the neck of the musical instrument and the fingerboard, those same mounting means and/or configurations would also be used with the retaining blank 282.

As indicated above, the underlying advantages of this invention which enable the substitution of a fretted fingerboard for a non-fretted fingerboard rely upon several unique features which operate in combination. Those features are the types of locking elements which are used and include, for example, a selected type of intermediate locking element and a differing type of end locking element, the determination of the number of intermediate locking elements which can be used, compensation for overall thickness in fretted versus non-fretted boards, and in the precise construction of the intermediate locking elements. Each of these features effectively depend upon one another in order to enable the very quick and efficient interchangeability of a fretted for a non-fretted fingerboard and vice versa. Thus, it is believed that without essentially most if not all of these unique features, the substitution of a fretted for a non-fretted fingerboard could be materially compromised.

Thus, there has been illustrated and described a unique and novel musical instrument of the type capable of having a removable and fretted fingerboard substituted for a non-fretted fingerboard and vice versa. The present invention therefore fulfills all of the objects and advantages which have been sought. It should be understood that many changes, modifications, variations and other uses and applications will become apparent to those skilled in the art after considering the specification and the accompanying drawings. Therefore, any and all such changes, modifications, variations and other uses and applications which do not depart from the spirit and the scope of the invention are deemed to be covered by the invention.

Having thus described the invention, what I desire to claim and secure by Letters Patent is:

1. A stringed musical instrument with capability of substituting a fretted fingerboard for a non-fretted fingerboard and vice versa, said instrument comprising:

a) a neck;

b) a plurality of strings extending across said neck;

c) a chamber enabling the generation of sounds responsive to vibration of said strings and the sound also being responsive to engagement of the strings in selected positions with respect to a fingerboard on said neck;

d) a first fingerboard removably mounted on said neck and having frets thereon which are selectively engagable by said strings allowing for a first group of musical sounds to be generated when said strings are physically engaged in contact with said frets on said first fingerboard and vibrated.

d) a second fingerboard removably mounted on said neck in place of said first fingerboard and having no frets thereon such that the strings are physically engaged in contact directly with the surface of the second fingerboard allowing for a second group of sounds to be generated when said strings are engaged with said fingerboard and vibrated; and f) whereby the same stringed musical instrument can be rapidly and easily converted from a fretted instrument to a non-fretted instrument and vice versa.

2. The stringed musical instrument of claim 1 further characterized in that each of said first and second fingerboards are retained on said neck in such manner that the fingerboard can be readily removably mounted on said neck and remounted without need for manually manipulatable mechanical fasteners.

3. The stringed musical instrument of claim 2 further characterized in that each said fingerboard is shiftable onto said neck from one longitudinal side of the neck and extends lengthwise of said neck, and slidable off of said neck and shiftable away from said neck from a longitudinal side of the neck to remove same from said neck.

4. The stringed musical instrument of claim 3, the improvement further characterized in that locking means is associated with said neck to limit sliding movement of the fingerboard when located on said neck so that said fingerboard is in a proper position on the neck when it has reached its limit of movement.

5. In the stringed musical instrument of the type having a neck with strings extending across said neck, and a sound generating chamber generating sounds responsive to vibration of said strings and the sounds also being responsible to engagement of the strings in selected positions with respect to a fingerboard on said neck, an improvement comprising:

a) a first fingerboard removably mounted on said neck and having frets thereon which are selectively engagable by said strings allowing for a first group of musical sounds to be generated when said strings are engage with said frets on said first fingerboard and vibrated;

b) a second fingerboard removably mounted on said neck in place of said first fingerboard and having no frets thereon such that the strings are engaged directly with a surface of the second fingerboard allowing for a second group of sounds to be generated when said strings are engaged with said fingerboard and vibrated, thereby allowing the same stringed musical instrument to become a fretted instrument and a non-fretted instrument; and c) said second fingerboard has a thickness which is equal to the thickness of the first fingerboard plus the thickness of the frets extending above a surface of that second fingerboard, such that the thickness of the first fingerboard in absence of any frets is less than that of the second fingerboard so that the distance between the strings and a surface contacted thereby is the same with both fingerboards and for the full length of the fingerboards.

6. In a stringed musical instrument of claim 5, the improvement further characterized in that each of said first and second fingerboards are retained on said neck in such a manner that the fingerboard can be readily removably mounted on said neck and remounted without need for manually actuable mechanical fasteners.

7. In a stringed musical instrument of claim 5, the improvement further characterized in that each said fingerboard is shiftable with respect to said neck from one longitudinal side of said neck to extend lengthwise of said neck, and is removed from said neck by shifting said fingerboard laterally to longitudinal side of said neck.

8. In a stringed musical instrument of claim 5, the improvement further characterized in that means is associated with said neck to limit sliding movement of the fingerboard when located on said neck so that the fingerboard is in a proper position on the neck when it has reached its limit of movement.

9. In a stringed musical instrument of claim 5, the improvement further characterized in that said fingerboard is secured to said neck by at least one end locking element and by a plurality of intermediate locking elements and where the end locking element has a different locking action than the intermediate locking elements but cooperate with the action of the intermediate locking elements.

10. In a stringed musical instrument of the type having a neck with strings extending across said neck, and a sound generating chamber generating sounds responsive to vibration of said strings and the sounds also being responsive to engagement of the strings in selected positions with a fingerboard on said neck, an improvement comprising the interchangeability of:

a) a first fingerboard removably mounted on said neck and having frets thereon which are selectively engagable by said strings allowing for a first group of musical sounds to be generated, with a second fingerboard removably mounted on said neck in place of said first fingerboard and having no frets thereon, such that the strings are engaged directly with an upper surface of the second fingerboard allowing for a second group of sounds to be generated;

b) said first fingerboard having a first thickness in which the frets extend above the upper surface of said neck and fingerboard such that the strings are engaged with the frets to control generation of musical sounds; and c) said second fingerboard having a thickness which is greater than the first thickness and where the second thickness is equal to the overall thickness of the first fingerboard and the frets thereon, such that the strings are engaged with the surface of the second fingerboard in selected positions to control generation of musical sounds and where the distance any string is moved downwardly to contact a surface is the same when either fingerboard is mounted on the neck of the musical instrument.

11. In a stringed musical instrument of claim 10, the improvement further characterized in that each said fingerboard is shiftable with respect to said neck from one longitudinal side of said neck to extend lengthwise of said neck, and is removed from said neck by shifting said fingerboard laterally to a longitudinal side of said neck.

12. In a stringed musical instrument of claim 10, the improvement further characterized in that each of said first and second fingerboards are retained on said neck in such manner that each fingerboard can be readily removably mounted on said neck and remounted without need for manual manipulation of mechanical fasteners.

13. In a stringed musical instrument of claim 12, the improvement further characterized in that each of said fingerboard is slidable onto said neck and off of said neck to remove same from said neck, and that means is associated with said neck to limit sliding movement of the fingerboard when inserted onto said neck so that said fingerboard is in proper position on the neck when it has reached its transverse limit of movement.

14. A stringed musical instrument capable of having a fingerboard rapidly removable from and remounted on a neck of the instrument, said musical instrument comprising:

a) an elongate neck having a paid of longitudinally spaced apart longitudinally extending side sections;

b) a fingerboard removably attached to and extending across said neck and having longitudinal edges extending longitudinally with respect to side walls of said neck;

c) at least one upstanding intermediate locking element on said neck and having beveled sections thereon;

d) at least one groove on a surface of said fingerboard sized to removably receive said at least one intermediate locking element when said fingerboard is mounted on said neck;

e) at least one end locking element on said elongate neck for engaging a region of the fingerboard in proximity to an end of the fingerboard, said end locking element being located in proximity to an end of the neck and having a different locking action than said intermediate locking element but cooperating with said intermediate locking element to increase the locking action provided by said intermediate locking element;

f) strings extending across and along said neck and said fingerboard; and g) a sound generating member connected to said neck and causing generation of musical sounds in response to vibration of said strings an din response to a selected engagement of the strings with the fingerboard.

15. The stringed musical instrument of claim 14 further characterized in that said at least one intermediate locking element is constructed so that said intermediate locking element slides into said groove when said fingerboard is shifted over said neck from one longitudinal side of said neck of said instrument toward the other to mount the fingerboard on the neck and out of the groove in a direction to remove the fingerboard from the neck.

16. The stringed musical instrument of claim 15 further characterized in that said at least one intermediate locking element is engaged in said groove such that the fingerboard can only be slid outwardly off of said intermediate locking element and shifted to one longitudinal side of said neck.

17. The stringed musical instrument of claim 14 further characterized in that said at least one end locking element comprises means for applying an upward biasing force on said fingerboard and thereby applying an uplifting force on the fingerboard to increase the locking action of the intermediate locking element.

18. The stringed musical instrument of claim 14 further characterized in that said at least one intermediate locking element has beveled side walls which are tapered from one side of the neck to the other allowing said fingerboard to be easily slidable onto said neck and off of said neck to remove same from said neck.

19. The stringed musical instrument of claim 18 further characterized in that said intermediate locking element is beveled on its side walls, such that it has a wider upper surface than lower surface preventing lifting of the fingerboard.

20. The stringed musical instrument of claim 19 further characterized in that said intermediate locking element has beveled side walls and a beveled connecting end wall.

21. The stringed musical instrument of claim 14 further characterized in that said at least one end locking element also limits sliding movement of the fingerboard when inserted onto said neck so that said fingerboard is in a proper position on the neck when it has reached its transverse limit of movement.

22. The stringed musical instrument of claim 14 further characterized in that the at least one intermediate locking element and said at least one groove are performed on separate plates such that one plate has at least one projection which fits into a groove formed in an upper surface of said second plate and said plates are respectively secured at said neck and fingerboard.

23. A stringed musical instrument having an elongate neck with a relatively large aspect ratio and which is reinforced over its length, said musical instrument comprising:

a) said elongate neck comprising a first end and a second end and also having a base section and a removable top plate, and having an elongate extent;

b) a resonant body at said first end of said elongate neck and being secured thereto and enabling the generation of sounds when strings extending thereacross are vibrated;

c) a head at said second end of said neck and being secured thereto and mounting ends of said strings;

d) an elongate longitudinal reinforcing and tuning member extending through said neck to reinforce said neck against cracking when subjected to bending moment forces when said top plate is removed and also provide for tuning of the instrument; and e) at least one additional longitudinal reinforced plastic composite reinforcing member extending through said neck to further reinforce against bending moment forces.

24. The stringed musical instrument of claim 23 further characterized in that at least one additional reinforced plastic composite reinforcing member extends through said neck on a side of said elongate reinforcing and tuning member.

25. The stringed musical instrument of claim 23 further characterized in that a pair of additional reinforced plastic composite members extend through said neck on opposite sides of said elongate reinforcing and tuning member.

26. A stringed musical instrument assembly capable of having a fingerboard rapidly removable from and remounted on a neck of the instrument, said musical instrument comprising:

a) a neck;

b) a fingerboard extending across said neck;

c) strings extending across and along said neck and said fingerboard;

d) a sound generating member connected to said neck and causing generation of musical sounds in response to vibration of said strings and in response to a selected engagement of the strings with the fingerboard;

e) means for retaining said fingerboard on said neck in such manner that the fingerboard can be rapidly disconnected from and remounted on said neck without manually manipulatable mechanical fasteners;

f) a retaining blank for receiving said fingerboard when not in use; and g) means for retaining said fingerboard on said blank when not in use to preclude warpage thereof.

27. The stringed musical instrument of claim 26 further characterized in that said fingerboard is slidable into a retaining recess in said neck and out of said recess to remove same from said neck and in a similar recess in said blank.

28. The stringed musical instrument of claim 26 further characterized in that means is associated with said neck to limit sliding movement of the fingerboard when inserted onto said neck from one longitudinal side thereof, so that said fingerboard is in a proper position on the neck when it has reached its limit of movement, and said retaining blank is provided with means to limit the movement of the fingerboard from one longitudinal side thereof on and off said blank.

29. A stringed musical instrument capable of substituting a fretted fingerboard for a non-fretted fingerboard and vice versa, said instrument comprising:

a) a neck;

b) a plurality of strings extending across said neck;

c) a sound generating chamber generating sounds responsive to vibration of said strings;

d) a fingerboard removably mounted on said neck allowing for groups of musical sounds to be generated when said strings are engaged in operative contact with said fingerboard and vibrated;

e) at least one end locking means on said neck and engaging a cooperating end locking element on said fingerboard in proximity to an end of said fingerboard, said end locking means providing an upwardly biasing force on said fingerboard which cooperates with other means to lock said fingerboard on said neck.

30. The stringed musical instrument of claim 29 further characterized in that:

a) said fingerboard is a first fingerboard which is fretted; and b) said instrument comprises a second fingerboard removably mountable on said neck in place of said first fingerboard and having no frets thereon such that the strings can be physically engaged in contact directly with a surface of the second fingerboard allowing for a different group of sounds to be generated when said strings are engaged with said fingerboard and vibrated.

31. The stringed musical instrument of claim 30 further characterized in that intermediate locking means is associated with said neck comprising at least one intermediate locking element which uses a wedge type action to releasably lock the fingerboard to the neck when inserted onto said neck.

32. A stringed musical instrument capable of having a fingerboard removable from and remounted on a neck of the instrument, said musical instrument comprising:

a) an elongate neck having a pair of longitudinally space apart longitudinally extending side sections;

b) a fingerboard removably attached to and extending longitudinally across said neck and having longitudinal edges extending longitudinally with respect to side walls of said neck;

c) a first plate provided for attachment to the upper surface of said neck;

d) a second plate provided for attachment to the underside of said fingerboard;

e) at least one first upstanding longitudinally arranged locking element on said first plate;

f) at least one second locking element on a surface of said second plate sized to removably lock with said cooperatively shaped first locking element when said fingerboard is mounted on said neck;

g) strings extending across and along said neck and said fingerboard; and h) a sound generating member connected to said neck and causing generation of musical sounds in response to vibration of said strings.

33. The stringed musical instrument of claim 32 further characterized in that said at least one first locking element is an upstanding locking element on said first plate and said cooperating second locking element is a groove on an undersurface of said second plate.

34. The stringed musical instrument of claim 33 further characterized in that said first locking element is an intermediate locking element, and at least one end locking element is on said first plate for engaging and end section of the second plate on said fingerboard, said end locking element being located in proximity to an end of the neck and having a different locking action than said intermediate locking element but cooperating with said intermediate locking element.

35. A stringed musical instrument capable of having a fingerboard rapidly removable from and remounted on a neck of the instrument, said musical instrument comprising:

a) an elongate neck having a pair of longitudinally space apart longitudinally extending side sections;

b) a first fingerboard removably attached to and extending across said neck and having frets thereon and longitudinal edges extending longitudinally with respect to side walls of said neck;

c) a second fingerboard suitable on said neck for said first fingerboard and having no frets thereon;

d) at least one upstanding longitudinally arranged intermediate locking element on said neck and having beveled sections thereon, said intermediate locking element having beveled side walls which are tapered from one side to the other, such that said locking element has wider upper portions than lower portions preventing lifting of the fingerboard, and allowing said fingerboard to be easily slidable onto said neck and off of said neck to remove same from said neck;

e) at least one groove on a surface of said fingerboard sized and having a corresponding shape to removably receive said intermediate locking element when said fingerboard is mounted on said neck;

f) said second fingerboard having a thickness which is equal to the thickness of the first fingerboard plus the thickness of the frets extending above a surface thereof so that the distance between the strings and a surface contacted thereby is the same with both fingerboards;

g) at least one end locking element on said elongate neck for engaging an end section of the fingerboard, said end locking element being located in proximity to an end of the neck and having a different locking action than said intermediate locking element to increase the locking action provided by said intermediate locking element;

h) said intermediate locking element being constructed so that said intermediate locking element slides into said groove after being shifted from one longitudinal side of said neck of said instrument toward the other to mount the fingerboard on the neck and out of the groove to remove the fingerboard from the neck;

i) strings extending across and along said neck and said fingerboard; and j) a sound generating member connected to said neck and causing generation of musical sounds in response to vibration of said strings and in response to a selected engagement of the strings with the fingerboard.

* * * * *